US008864367B2

(12) United States Patent
Hanada et al.

(10) Patent No.: US 8,864,367 B2
(45) Date of Patent: Oct. 21, 2014

(54) FLUID MIXER AND APPARATUS USING FLUID MIXER

(75) Inventors: Toshihiro Hanada, Nobeoka (JP); Takashi Yamada, Nobeoka (JP)

(73) Assignee: Asahi Organic Chemicals Industry Co., Ltd., Nobeoka-Shi, Miyazaki (JP)

( * ) Notice: Subject to any disclaimer, the term of this patent is extended or adjusted under 35 U.S.C. 154(b) by 159 days.

(21) Appl. No.: 13/577,381

(22) PCT Filed: Dec. 21, 2010

(86) PCT No.: PCT/JP2010/073659

§ 371 (c)(1),
(2), (4) Date: Aug. 6, 2012

(87) PCT Pub. No.: WO2011/096152

PCT Pub. Date: Aug. 11, 2011

(65) Prior Publication Data

US 2012/0307589 A1 Dec. 6, 2012

(30) Foreign Application Priority Data

Feb. 5, 2010 (JP) ..... 2010-024138

(51) Int. Cl.
*B01F 5/06* (2006.01)
*B01F 3/08* (2006.01)

(52) U.S. Cl.
CPC ..... *B01F 5/0646* (2013.01); *B01F 2003/0896* (2013.01); *B01F 5/0656* (2013.01); *B01F 5/0647* (2013.01); *B01F 5/0657* (2013.01); *B01F 3/0861* (2013.01)
USPC ..... 366/339; 366/338

(58) Field of Classification Search
CPC .... B01F 5/0682; B01F 13/0059; B01F 5/064; B01F 5/0656
USPC ..... 366/336, 337, 338, 339, 340
See application file for complete search history.

(56) References Cited

U.S. PATENT DOCUMENTS 2,784,948 A * 3/1957 Pahl et al. ..... 366/339
7,416,404 B2 * 8/2008 Chan ..... 366/338

FOREIGN PATENT DOCUMENTS

JP 51-091175 A 8/1976
JP 58-036626 A 3/1983

(Continued)

OTHER PUBLICATIONS

International Search Report (PCT/ISA/210) issued on Apr. 19, 2011, by the Japanese Patent Office as the International Searching Authority for International Application No. PCT/JP2010/073659.

*Primary Examiner* — Tony G Soohoo
*Assistant Examiner* — Anshu Bhatia
(74) *Attorney, Agent, or Firm* — Buchanan, Ingersoll & Rooney PC

(57) ABSTRACT

A fluid mixer includes a main flow path comprised of a first flow path and a second flow path, spiral flow paths formed around the second flow path in shapes substantially concentric with the second flow path and offset in position from each other in a circumferential direction, the spiral flow paths having first ends communicated with the first flow path, branch flow paths branched from a plurality of locations of the second flow path in a flow direction, the branch flow paths being communicated with the spiral flow paths at a plurality of locations of the spiral flow paths in the flow direction, a fluid inlet at an open end of either of the first flow path and the second flow path, and a fluid outlet at an open end of the other of the first flow path and the second flow path.

8 Claims, 18 Drawing Sheets

(56) References Cited

FOREIGN PATENT DOCUMENTS

| | | | |
|---|---|---|---|
| JP | 63-016037 | A | 1/1988 |
| JP | 2001-205062 | A | 7/2001 |
| JP | 2005-034750 | A | 2/2005 |
| JP | 2007-090262 | A | 4/2007 |

* cited by examiner

FLUID MIXER AND APPARATUS USING FLUID MIXER

CROSS-REFERENCE TO RELATED APPLICATION

This application is a National Stage of PCT international application Ser. No. PCT/JP2010/073659 filed on Dec. 21, 2010 which designates the United States, incorporated herein by reference, and which is based upon and claims the benefit of priority from Japanese Patent Application No. 2010-024138, filed on Feb. 5, 2010, the entire contents of which are incorporated herein by reference.

TECHNICAL FIELD

The present invention relates to a fluid mixer which is used for fluid transport piping in various industrial fields such as chemical factories, the semiconductor production field, food field, medical field, biotech field, etc., in particular relates to a fluid mixer and apparatus using a fluid mixer which are able to mix fluid while making the distribution of concentration or distribution of temperature of the fluid in the direction of flow uniform without unevenness.

BACKGROUND ART

In the past, as the method of attaching a device inside of a pipe to uniformly mix fluid flowing through the inside of the pipe, as shown in FIG. 18, use of a twisted blade type static mixer element 151 has been the general practice (see, for example, Patent Literature 1). Usually, the static mixer element 151 is comprised of a square plate twisted 180 degrees about its longitudinal axis as a minimum unit member and has a plurality of such minimum unit members integrally connected in series so that the twisting directions become mutually different directions. This static mixer element 151 is arranged in a pipe 152, male connectors 153 are attached to the two ends of the pipe 152, flare nuts 155 are attached, and fastening nuts 154 are fastened, whereby a static mixer is formed. At this time, the outside diameter of the static mixer element 151 is designed to be substantially equal to the inside diameter of the pipe 152, so the fluid is able to be effectively agitated.

However, the method of mixing fluid using this conventional static mixer is to agitate a flow of fluid along the flow, so as shown in FIG. 19*a*. Therefore, although it is possible to make the distribution of concentration in the radial direction of the pipe uniform without any unevenness, it is not possible to make the distribution of concentration in the axial direction (flow direction) uniform without any unevenness, as shown in FIG. 19*b*. For this reason, for example, when mixing water and a chemical at the upstream side of the static mixer, if the mixing ratio of the chemical temporarily increases, the fluid will pass through the static mixer in a state partially denser in concentration in the flow path. At this time, even if the water and chemical are agitated and made uniform in concentration in the radial direction, in the axial direction (flow direction), locations in the flow path where the concentration partially becomes denser will end up flowing to the downstream side in the dense state as they are without being diluted much at all (see FIG. 19*b*). Due to this, when connected to a semiconductor washing apparatus, in particular, an apparatus which directly coats the surface of a semiconductor wafer with a chemical to perform various types of treatment, there is the problem that different concentrations of the chemical are coated on the surface of the semiconductor wafer and thereby causes defects.

As a method for avoiding unevenness in the distribution of concentration in the axial direction (flow direction), the method of installing a tank in the middle of the flow path, storing fluid temporarily in the tank, making the concentration in the tank uniform, then running the fluid (not shown) etc. may be mentioned. However, there is the problem that a large space is required for installing the tank and therefore the apparatus becomes larger. Further, the transport of the fluid from the tank again requires a pump, piping, etc., so the number of the parts for use increase, and cost is incurred for installing the pipeline. Further, with this method, the fluid stagnates in the tank, so becomes a cause of proliferation of bacteria. The bacteria proliferating in the tank flows into the pipeline and, in a semiconductor production line, the bacteria deposits on the semiconductor wafer and therefore causes defects.

CITATIONS LIST

Patent Literature 1:
Japanese Unexamined Patent Publication No. 2001-205062

SUMMARY OF INVENTION

The present invention is made in consideration of the above problem in the prior art and has as its object the provision of a compact configuration fluid mixer and apparatus using a fluid mixer which can mix and agitate fluid while making a distribution of concentration or distribution of temperature of the fluid in the direction of flow uniform without any unevenness.

The fluid mixer according to the present invention includes a main flow path comprised of a first flow path and a second flow path; a plurality of spiral flow paths formed around the second flow path in shapes substantially concentric with the second flow path, and provided offset in position from each other in a circumferential direction, the plurality of spiral flow paths having first ends communicated with the first flow path; a plurality of branch flow paths branched from a plurality of locations of the second flow path in a flow direction, the plurality of branch flow path being communicated with the plurality of spiral flow paths at a plurality of locations of the plurality of spiral flow paths in the flow direction; a fluid inlet provided at an open end of either of the first flow path and the second flow path; and a fluid outlet provided at an open end of the other of the first flow path and the second flow path.

DESCRIPTION OF EMBODIMENTS

Figure 1:
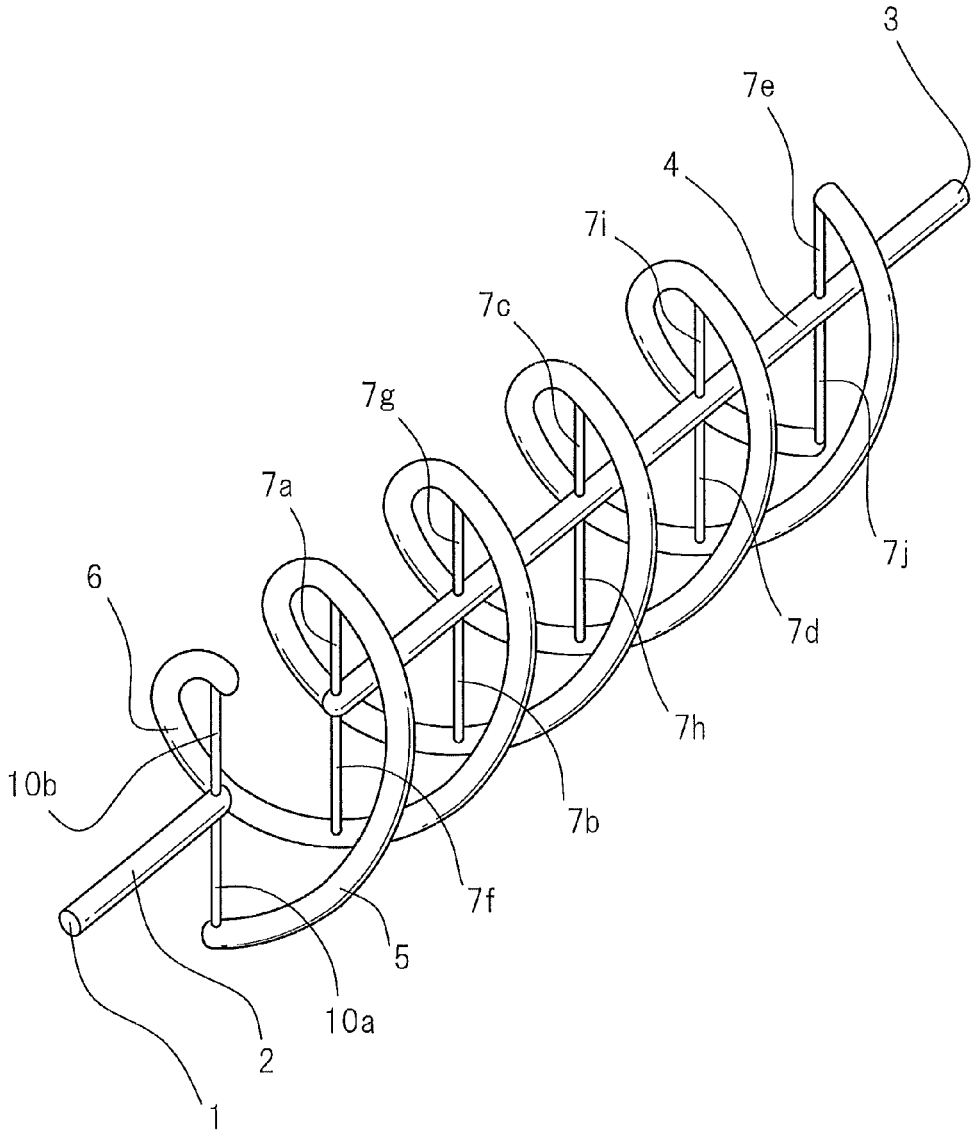
FIG. 1 is a perspective view which shows a schematic configuration of a fluid mixer according to a first embodiment of the present invention.

Below, although embodiments of the present invention will be described with reference to the embodiments which are shown in the drawings, the present invention is not limited to these embodiments needless to say.

First Embodiment

Hereafter, referring to FIG. 1 to FIG. 4, a fluid mixer according to a first embodiment of the present invention will be explained. FIG. 1 is a perspective view which shows the schematic configuration of a fluid mixer according to the first embodiment. This fluid mixer has a mixing flow path for mixing different types of fluids. The mixing flow path is formed by a tube made of for example PFA (tetrafluoroethylene-perfluoroalkyl vinyl ether copolymer resin). Metal piping or another material may be used to form the mixing flow path as well.

The mixing flow path has a fluid inlet 1 into which fluid flows, a first flow path 2 to which the fluid inlet 1 is provided at one end, a fluid outlet 3 from which fluid flows out, a second flow path 4 to which the fluid outlet 3 is provided at the opposite side end from the fluid inlet 1, a first spiral flow path 5 and a second spiral flow path 6 which are provided concentrically around the flow paths 2 and 4 as the center axes of the spirals, a pair of communicating flow paths 10*a* and 10*b* which communicate the first flow path 2 with the first spiral flow path 5 and the second spiral flow path 6, and a plurality of branch flow paths 7*a* to 7*e* and 7*f* to 7*j* which communicate the second flow path 4 with the first spiral flow path 5 and the second spiral flow path 6.

The first flow path 2 and the second flow path 4 are straight flow paths which are arranged separated from each other on the same axis. These form the main flow path. The first spiral flow path 5 and the second spiral flow path 6 are substantially identical in shape. The flow cross-sectional shapes with respect to the flow path axis are the same as each other. The centers of the spirals of these spiral flow paths 5 and 6 are on the same axis. The spiral flow paths 5 and 6 are arranged at a fixed interval from each other in the axial direction. More specifically, they are arranged offset in position (phase) from each other in the circumferential direction so as not to intersect.

The communicating flow paths 10*a* and 10*b* and the branch flow paths 7*a* to 7*j* are formed approximately straight, that is, straight or substantially straight. The communicating flow paths 10*a* and 10*b* are branched from the end of the first flow path 2 at the side opposite to the fluid inlet 1. The communicating flow paths 10*a* and 10*b* extend to axially symmetric positions in an approximately vertical plane to the first flow path 2, that is, in a vertical or substantially vertical plane. The communicating flow paths 10*a* and 10*b* are respectively connected to the first spiral flow path 5 and the second spiral flow path 6 at the fluid inlet side ends. The first flow path 2 communicates with the first spiral flow path 5 and second spiral flow path 6 through the communicating flow paths 10*a* and 10*b*.

The branch flow paths 7*a* to 7*j* are branched from a plurality of locations of the second flow path 4 in the flow direction. More specifically, a pair of branch flow paths 7*a* and 7*f* are branched from the fluid inlet side end of the second flow path 4, then a pair of branch flow paths 7*b* and 7*g*, a pair of branch flow paths 7*c* and 7*h*, a pair of branch flow paths 7*d* and 7*i*, and a pair of branch flow paths 7*e* and 7*j* are branched from the second flow path 4 along the flow direction of the fluid. These branch flow paths 7*a* to 7*e* and branch flow paths 7*f* to 7*j* extend in approximately vertical planes with respect to the second flow path 4, that is, in vertical or substantially vertical planes, at axially symmetric positions. The branch flow paths 7*a* to 7*e* are respectively connected to the first spiral flow path 5, the spiral flow paths 7*f* to 7*j* are respectively connected to the second spiral flow path 6, and the second flow path 4 and first spiral flow path 5 and second spiral flow path 6 communicate with each other through the branch flow paths 7*a* to 7*j*. The ends of the first spiral flow path 5 and the second spiral flow path 6 have branch flow paths 7*e* and 7*j* connected to them. In the figure, the pair of communicating flow paths 10*a* and 10*b* at the end of the first flow path 2 and the pairs of branch flow paths 7*a* to 7*e* and 7*f* to 7*j* at the plurality of locations of the second flow path 4 are respectively provided at axially symmetric positions. However, the positions where these communicating flow paths 10*a* and 10*b* and branch flow paths 7*a* to 7*e* and 7*f* to 7*j* are provided are not limited to this.

Figure 10:
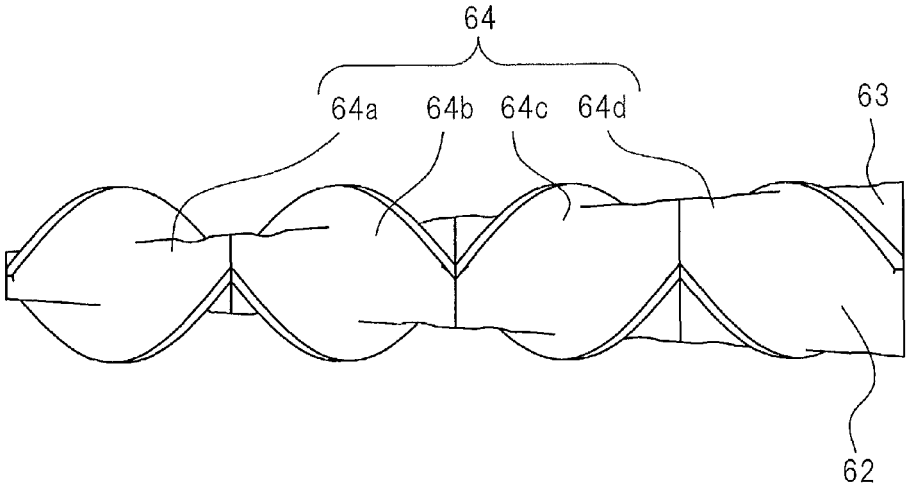
FIG. 10 is a front view which shows an example changing the spiral grooves of the main body.

Note that, the spiral flow paths (spiral grooves) of the present application include not only paths of a spiral structure which turn in a spiral along the flow path axial direction constantly in the forward direction, but also ones which turn in a spiral along the flow path axial direction in the forward direction, turn in the reverse direction in the middle of that, then alternately change in direction of the spiral to the forward direction and reverse direction (see FIG. 10). It is also possible to make a plurality of spiral flow paths communicate with each other in the middle and split and mix the fluid which flows through the spiral flow paths by forming a plurality of spiral flow paths which are branched from the first flow path 2 (see FIG. 11).

Next, the operation of the fluid mixer of the first embodiment of the present invention will be explained.

If mixing water and a chemical at the upstream side of the fluid mixer and running them in the state where the concentration of the chemical temporarily becomes stronger, the partially denser concentration flowing chemical (high concentration chemical) flows in from the fluid inlet 1 to the first flow path 2. This high concentration chemical is divided through the communicating flow paths 10*a* and 10*b* to the first spiral flow path 5 and second spiral flow path 6. If the divided high concentration chemical flows through the connecting parts of the branch flow paths 7*a* and 7*f* at the first spiral flow path 5 and second spiral flow path 6, part of the high concentration chemical flows through the branch flow paths 7*a* and 7*f* to the second flow path 4. If the remaining high concentration chemical flows to the downstream side of the first spiral flow path 5 and second spiral flow path 6 and flows through the connecting parts of the branch flow paths 7*b* and 7*g* inside the spiral flow paths 5 and 6, part flows through the branch flow paths 7*b* and 7*g* to the second flow path 4. After this, in the same way as above, the remaining high concentration chemical flows a little at a time from the branch flow paths 7*c*, 7*d*, and 7*e* and the branch flow paths 7*h*, 7*i*, and 7*j* to the second flow path 4. The high concentration chemical which flows through the branch flow paths 7*a* to 7*j* into the second flow path 4 flows out from the fluid outlet 3.

At this time, the partially denser concentration chemical which flows through the upstream side branch flow paths 7*a* and 7*f* flows out from the fluid outlet 3 faster than the high concentration chemical which flows through the other branch flow paths 7*b* to 7*e* and 7*g* to 7*j* since the length of the flow path from the fluid inlet 1 to the fluid outlet 3 is the shortest. Next, the high concentration chemical which flows through the branch flow paths 7*b* and 7*g*, branch flow paths 7*c* and 7*h*, branch flow paths 7*d* and 7*i*, and branch flow paths 7*e* and 7*j* flows out in that order from the fluid outlet 3. More specifically, the chemical which flows partially denser in concentration inside the flow path is split by the fluid mixer a little at a time from the first spiral flow path 5 and second spiral flow path 6 to the branch flow paths 7*a* to 7*e* and 7*f* to 7*j* at different timings to be mixed with chemical which has not become denser in concentration. Due to this, it is possible to make the distribution of concentration of the fluid in the flow direction uniform without any unevenness.

Further, the fluid mixer of the present embodiment is configured so that the fluid is divided through the communicating flow paths 10*a* and 10*b* from the first flow path 2 to the plurality of spiral flow paths 5 and 6. Due to this, the fluid is divided in the radial direction and flows to be agitated in the radial direction. After that, the fluid runs from the spiral flow paths 5 and 6 through the branch flow paths 7*a* to 7*j*, and flows into the second flow path 4 while giving rise to a time difference, whereby the fluid is mixed in the flow direction. For this reason, it is possible to increase the frequency of dividing and mixing the fluid to raise the agitation effect by a simple configuration, and possible to easily produce a fluid mixer which has a flow path configuration with a high agitation effect.

Note that, as shown in FIG. 1, in the present embodiment, the branch flow paths 7*a* to 7*e* and branch flow paths 7*f* to 7*j* are provided at equidistant and axially symmetric positions along the flow path axis of the second flow path 4. However, in order to adjust the time difference which is given to the fluid which flows through the branch flow paths 7*a* to 7*e* and branch flow paths 7*f* to 7*j*, the positions where the branch flow paths 7*a* to 7*j* are connected may be freely set. It is also possible to gradually reduce the flow cross-sectional areas of the first spiral flow path 5 and the second spiral flow path 6 from one end connected to the first flow path 2 toward the other end.

Further, the plurality of branch flow paths 7*a* to 7*e* and branch flow paths 7*f* to 7*j* may be connected to positions offset from the axis of the second flow path 4 and may be connected to positions offset from the axes of the first and second spiral flow paths 5 and 6. More specifically, the branch flow paths 7*a* to 7*g* and branch flow paths 7*f* to 7*j* may be provided so that the extensions of the center axes of the branch flow paths 7*a* to 7*e* and branch flow paths 7*f* to 7*j* (axes passing through centers of flow cross-sectional area) do not intersect the center axis of the second flow path 4*a*, and do not intersect the center axes of the first and second spiral flow paths 5 and 6. At this time, the chemical gives rise to a swirling flow along the inside walls of the first and second spiral flow paths 5 and 6 or the second flow path 4, whereby the chemical is agitated inside of the flow paths, so the fluid is mixed in the radial direction. By causing a swirling flow inside the flow paths, it is possible to eliminate the dead spaces inside of the flow paths and prevent stagnation of the fluid. At this time, it is also possible to make the bottom surfaces of the spiral flow paths 5 and 6 arc shaped to more smoothly cause the swirling flow.

The number of the branch flow paths 7*a* to 7*j* is not limited to the one explained above. Increasing the number of branch flow paths 7*a* to 7*j* enables the distribution of concentration of the fluid in the flow direction to be made finer and more uniform without any unevenness. In the present embodiment, although two spiral flow paths 5 and 6 are provided, three or more may also be provided. The larger the number of spiral flow paths, the greater the opportunities for splitting and mixing of the fluid. Therefore, it is possible to enhance the agitation effect in the radial direction, and the distribution of concentration can be made finer and uniform in the flow direction.

Figure 2:
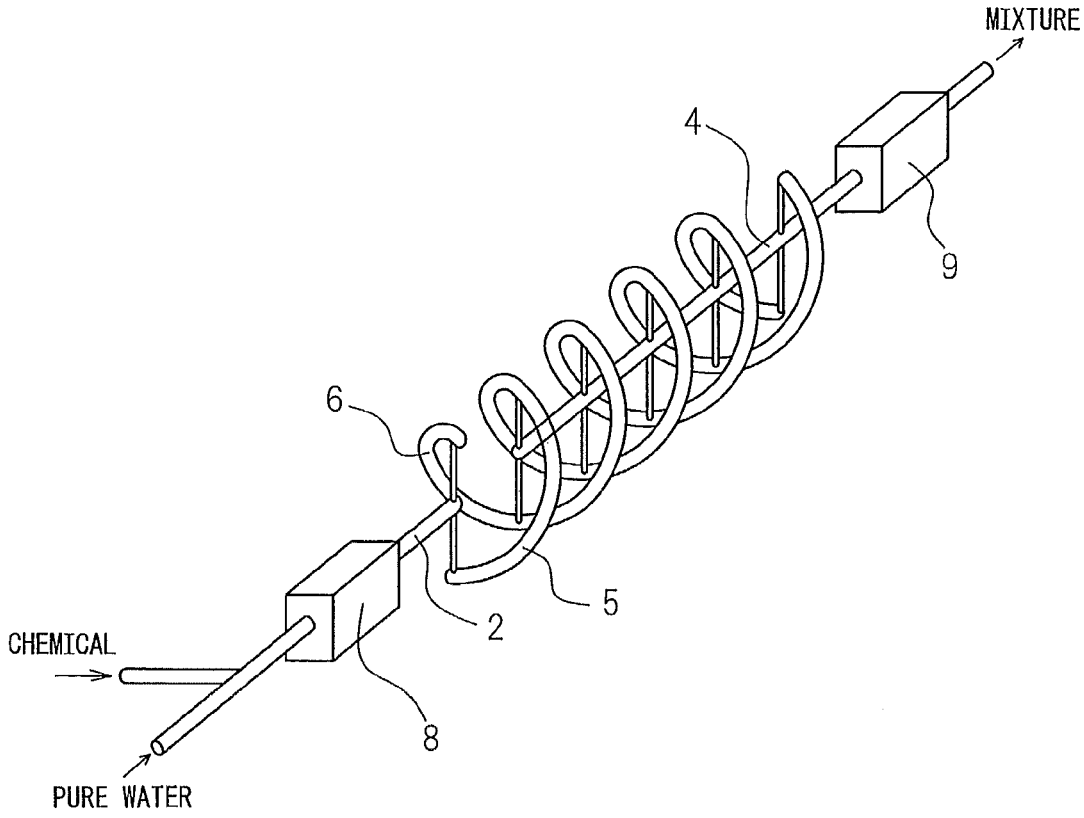
FIG. 2 is a schematic view which shows an apparatus for measuring a concentration of fluid by using the fluid mixer of FIG. 1.

Here, the point of splitting the partially denser concentration flowing chemical by the fluid mixer so that the distribution of concentration of fluid in the flow direction is made uniform without any unevenness will be explained. As shown in FIG. 2, in a line where the fluid mixer of FIG. 1 is arranged at the downstream side of a merging part of lines through which two substances, that is, pure water and a chemical, respectively flow, densitometers 8 and 9 are set at the upstream side and the downstream side of the fluid mixer of FIG. 1 to thereby prepare an apparatus which mixes pure water and a chemical from the upstream side. This apparatus is used to increase the concentration of the chemical instantaneously in the middle of running pure water and the chemical by a fixed ratio (increase the ratio of chemical relative to pure water) in state then return them to the original fixed ratio so as to create unevenness in the distribution of concentration. If measuring the upstream side and downstream side concentrations at this time, the result becomes as shown in FIG. 3 and FIG. 4.

Figure 3:
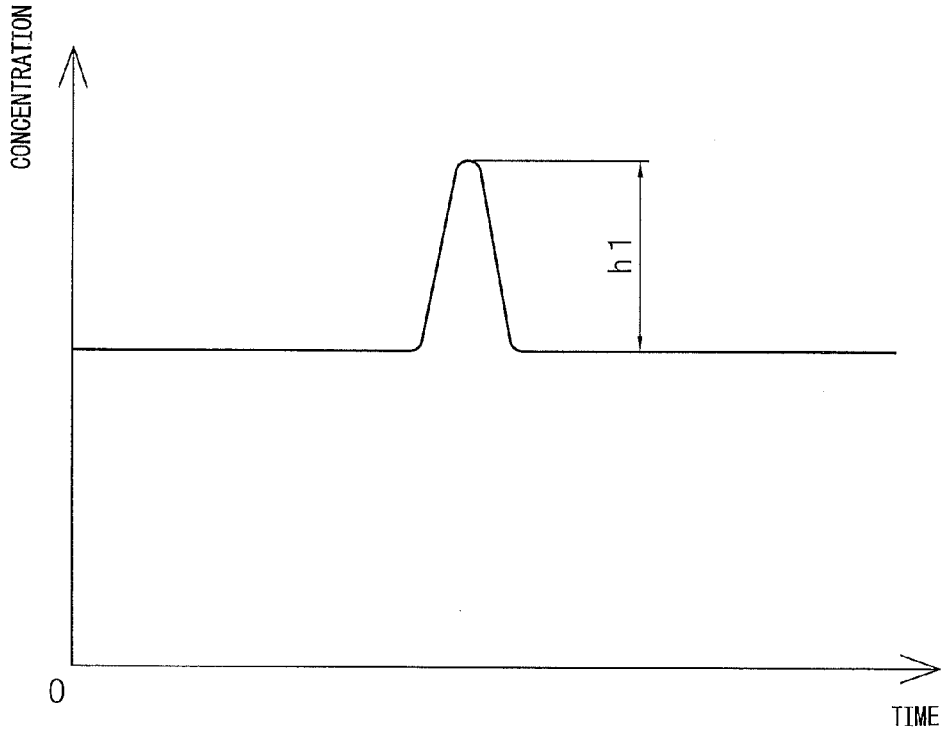
FIG. 3 is a graph of measurement of the concentration at an upstream side of the fluid mixer of FIG. 2.
Figure 4:
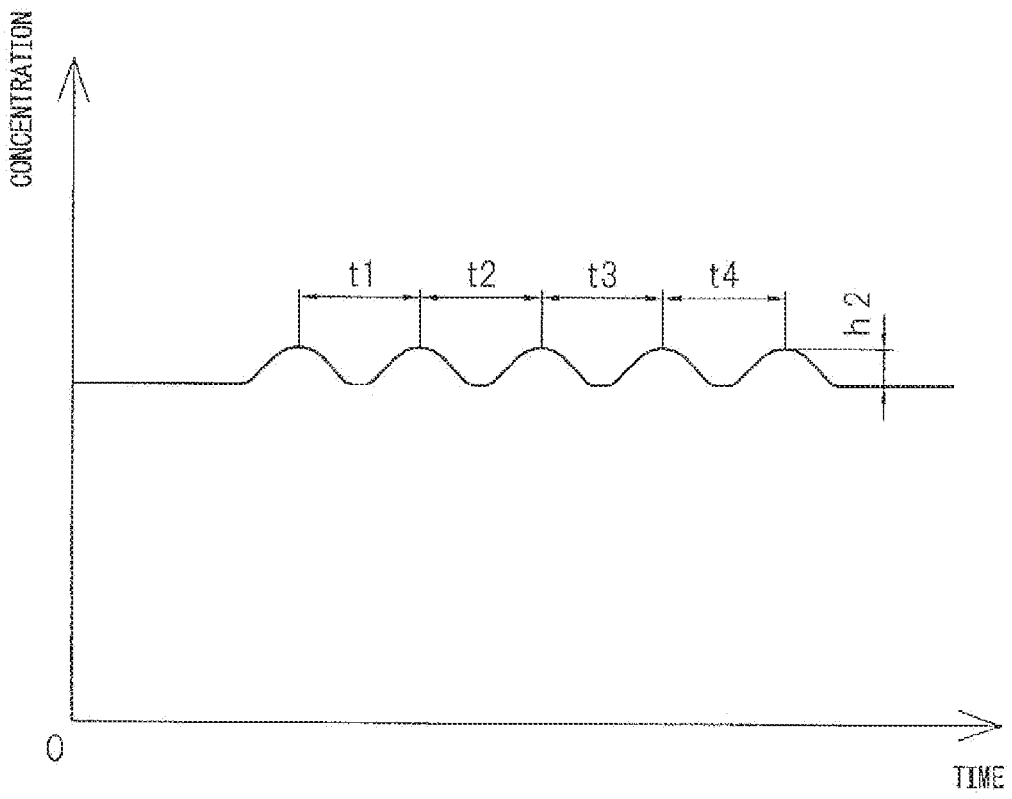
FIG. 4 is a graph of measurement of the concentration at a downstream side of the fluid mixer of FIG. 2.

FIG. 3 shows the characteristic obtained by the densitometer 8 which is set at the upstream side of the fluid mixer. Here, the abscissa shows the elapsed time, while the ordinate shows the concentration. If the concentration becomes denser for a certain time period, a peak (h1) such as illustrated appears. FIG. 4 shows the characteristic obtained by the densitometer 9 which is set at the downstream side of the fluid mixer. In the figure, the peak of concentration is dispersed to five peaks and the height of the peaks (h2) becomes about one-fifth. The time interval t1 between the peaks of concentration corresponds to the time from when a fluid passes the positions of the branch flow paths 7*a* and 7*f* inside of the first flow path 1 to when it reaches the branch flow paths 7*b* and 7*g*. Similarly, t2 corresponds to the time from the branch flow paths 7*b* and 7*g* to the branch flow paths 7*c* and 7*h*, t3 corresponds to the time from the branch flow paths 7*c* and 7*h* to the branch flow paths 7*d* and 7*i*, and t4 corresponds to the time from the branch flow paths 7*d* and 7*i* to the branch flow paths 7*e* and 7*j*.

At this time, by changing the lengths to the branch flow paths 7*a* to 7*e* and branch flow paths 7*f* to 7*j* of the first and second spiral flow paths 5 and 6, it is possible to change the time intervals t1 to t4 where the peaks (h2) appear. Further, if shifting the connection positions of the branch flow paths 7*a* to 7*e* and branch flow paths 7*f* to 7*j* to the second flow path 4 or increasing the number of the branch flow paths 7*a* to 7*e* and branch flow paths 7*f* to 7*j*, the heights of the peaks (h2) can be kept down to heights of an extent dividing the peak (h1) of the upstream side by the number of branch flow paths. Note that, even if not installing a fluid mixer, the peak of the concentration shown in FIG. 3 sometimes may fall somewhat due to the flow of fluid. However, the peak (h1) will appear substantially without changing. In the present embodiment, although the plurality of branch flow paths 7*a* to 7*e* and branch flow paths 7*f* to 7*j* communicate with the same positions of the second flow path 4 axially symmetrically, the positions communicating with the second flow path 4 may be shifted between the branch flow parts 7*a* to 7*e* and the branch flow paths 7*f* to 7*j*. At this time, the distance of the flow path from the fluid inlet 1 to the fluid outlet 3 differs, so the peak of concentration is dispersed to 10 peaks and the heights of the peaks (h2) become about one-tenth. For this reason, it is possible to make the distribution of concentration of the fluid in the flow direction finer and uniform without any unevenness.

In the present embodiment, although the fluid inlet 1 is configured as a fluid inlet part and the fluid outlet 3 is configured as a fluid outlet part for running fluid from the fluid inlet part to the fluid outlet part, it is possible to obtain a similar effect even of running fluid in the reverse direction. In this case, the fluid outlet 3 becomes the fluid inlet part, and the fluid inlet 1 becomes the fluid outlet part.

Note that, in the present embodiment, the unevenness of the distribution of concentration is explained. However, it is possible to obtain a similar effect even for making uniform the distribution of temperature in the flow direction at the time of mixing and running hot water and cold water. Utilization for a hot water heater etc. for the purpose of making the distribution of temperature uniform is also possible. In this case, it is possible to make the temperature uniform in the flow direction of fluid which partially becomes high in temperature inside of the flow path, and thereby possible to stabilize the temperature and prevent outflow of scalding water.

Figure 20:
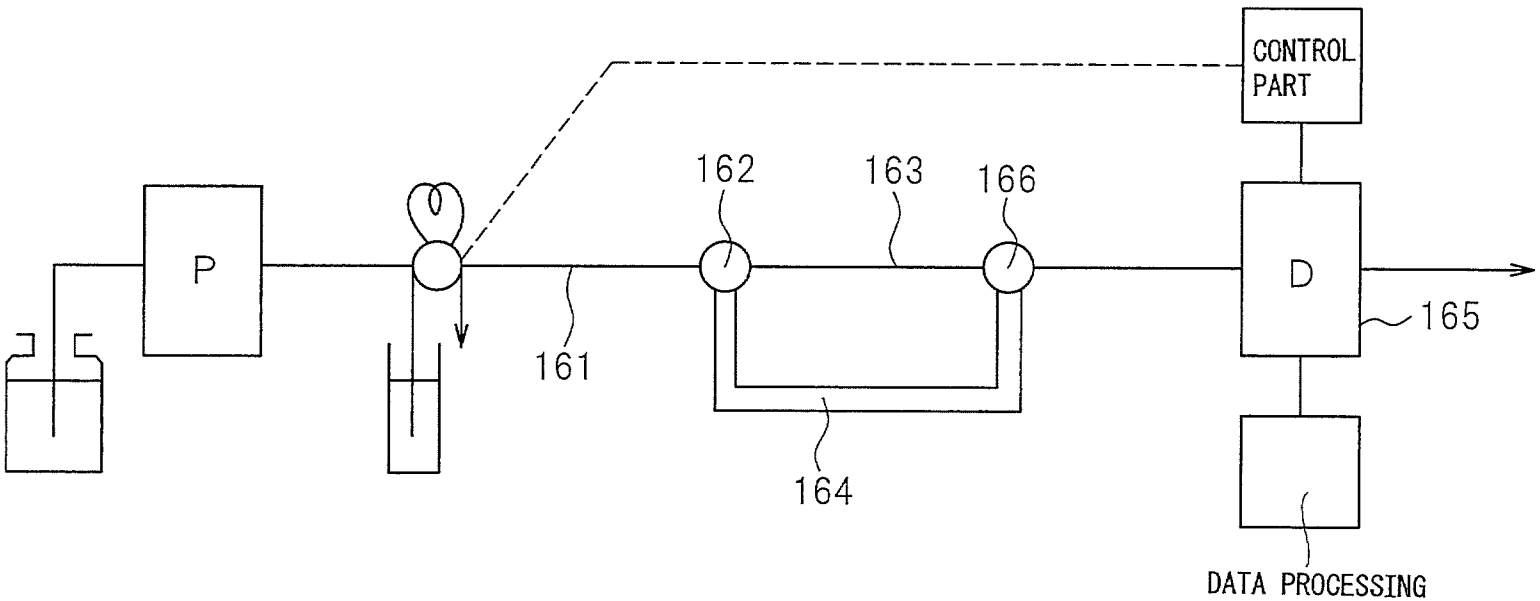
FIG. 20 is a longitudinal cross-sectional view of a branching and diluting device as a comparative example of the present invention.

FIG. 20 is a comparative example of the present embodiment and shows another method for avoiding unevenness of the distribution of concentration in the axial direction (flow direction). FIG. 20 shows a branch dilution apparatus which branches the flow path to dilute the fluid. This apparatus analyzes a test solution which flows through a thin pipe 161 at a constant speed. The sample solution is divided by providing a branch part 162 which branches the flowing sample to a plurality of flow paths in the middle of the flow path. Further, the inside diameters and lengths of the thin pipes 163 and 164 of the branch flow paths are changed to make the paths again merge at the merging part 166 in front of the detector 165. The time difference at which the sample solution is detected is utilized for dilution.

However, when using the art of the branch dilution apparatus of FIG. 20 for a fluid transport piping, it is necessary to form a piping line which provides pipelines of different lengths branched from the middle of a pipeline and make them merge back again. For this reason, to make the distribution of concentration in the axial direction (flow direction) in the flow path uniform without unevenness, it is necessary to provide a large number of branched flow paths. The installation space of the piping line increases. Further, to install such a piping line, the number of parts becomes greater and the work becomes troublesome and time consuming. On this point, in the present embodiment, there is no need to increase the installation space of the piping. The piping work is also easy and can be performed in a short time.

Second Embodiment

Figure 5:
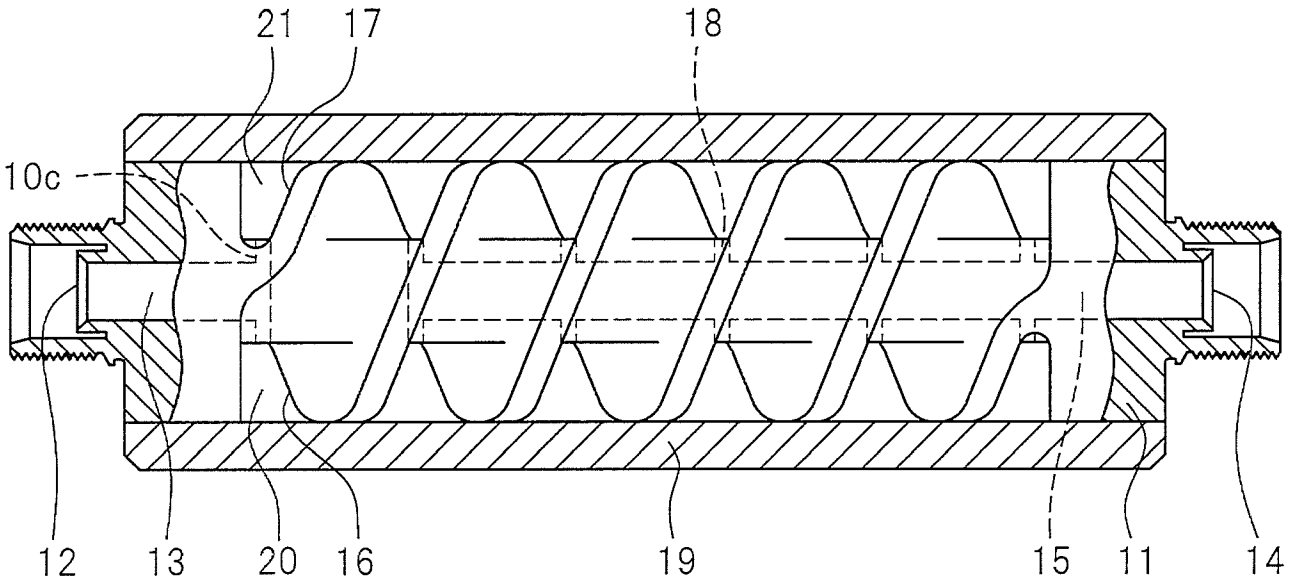
FIG. 5 is a partial longitudinal cross-sectional view which shows the inside of a fluid mixer according to a second embodiment of the present invention.
Figure 6:
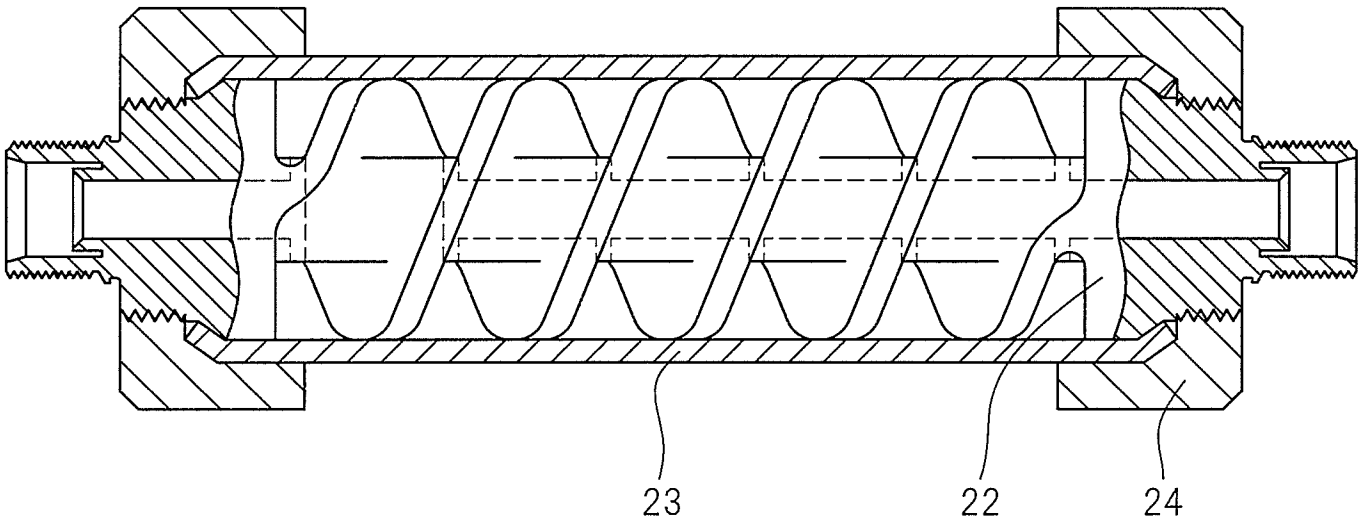
FIG. 6 is a partial longitudinal cross-sectional view which shows a modification of FIG. 5.

Next, referring to FIGS. 5 to 7, a fluid mixer according to a second embodiment of the present invention will be explained. FIG. 5 is a partial longitudinal cross-sectional view which shows an internal configuration of the fluid mixer according to the second embodiment. In the second embodiment, an approximately cylindrically shaped, that is, a cylindrically shaped or a substantially cylindrically shaped, a main body 11 and a cylindrical member 19 which fits over the outer circumferential surface of the main body 11 are used to form a fluid mixer which has a mixing flow path.

The main body 11 is made of PTFE (polytetrafluoroethylene). Inside the main body 11, a first flow path 13 and a second flow path 15 of a main flow path are provided separated from each other on the center axis of the main body 11. At one end face of the main body 11, a fluid inlet 12 is provided which communicates with an end of the first flow path 13 (an end at opposite side to second flow path 15), while at the other end face, a fluid outlet 14 is provided which communicates with an end of the second flow path 15 (an end at opposite side to first flow path 13). At the outer circumferential surface of the main body 11, a first spiral groove 16 and a second spiral groove 17 are formed. The first spiral groove 16 and the second spiral groove 17 are the same shape as each other. The cross-sectional shapes of the spiral grooves 16 and 17 with respect to the flow path axis are the same as each other. These spiral grooves 16 and 17 are alternately formed at certain interval in the axial direction, that is, are formed offset in position (phase) in the circumferential direction.

At the end of the first flow path 13 at the opposite side of the fluid inlet 12, a pair of communicating holes 10*c* are formed and oriented toward the outside in the radial direction. Due to the communicating holes 10*c*, communicating flow paths which branch from the first flow path 13 are formed. The communicating holes 10*c* extend in approximately straight shapes from the first flow path 13 in mutually opposite directions. Through the communicating holes 10*c*, the end of the first flow path 13 is communicated with the first spiral groove 16 and second spiral groove 17 at their fluid inlet 12 side ends. At the second flow path 15, a pair of communicating holes 18 are formed and oriented toward the outside in the radial direction at a plurality of locations in the flow direction. Due to the communicating holes 18, branch flow paths which branch from the second flow path 15 are formed. The pairs of communicating holes 18 extend in approximately straight shapes from the second flow path 15 in opposite directions to each other. Through these communicating holes 18, the second flow path 15 communicates with the first spiral groove 16 and second spiral groove 17 at a plurality of locations. Note that, the communicating holes 18 which are positioned at the location nearest to the fluid outlet 14 side communicate with the first spiral groove 16 and second spiral groove 17 at the fluid outlet 14 side ends. In the figure, the pair of communicating holes 10*c* at the end of the first flow path 13 and the pairs of communicating holes 18 at the plurality of locations of the second flow path are provided at axially symmetric positions. However, the positions at which these communicating holes 10*c* and 18 are provided are not limited to these.

The cylindrical member 19 is a housing made of a PFA tube and is formed into an approximately cylindrical shape, that is, a cylindrical or substantially cylindrical shape. The inside diameter of the cylindrical member 19 is approximately the same as the outside diameter of the main body 11. By shrink fitting the main body 11 and the tube constituted by the cylindrical member 19, the cylindrical member 19 is fit over the outer circumferential surface of the main body 11 in a sealed state. By fitting the cylindrical member 19 over the main body 11, the first spiral groove 16 of the main body 11 and the inner circumferential surface of the cylindrical member 19 form the first spiral flow path 20, while the second spiral groove 17 of the main body 11 and the inner circumferential surface of the cylindrical member 19 form the second spiral flow path 21.

Note that, the cylindrical member 19 may also be formed by something other than a soft member like a tube. It may also be formed by a hard member. The shape of the housing may be other than a cylindrical member as well, for example, may be a block shape etc. So long as fitting the cylindrical member 19 over the main body 11 in a sealed state, any method may be used to fasten the cylindrical member 19. Other than shrink fitting, welding or bonding may be used for fastening. For example, as shown in FIG. 6, it is also possible to fit a cylindrical member 23 made of a PFA tube over the main body 22 in a tight state and screw cap nuts 24 on both ends of the main body 22 so as to fasten the cylindrical member 23 to the outer circumferential surface of the main body 22 in a sealed state. As shown in FIG. 7, it is also possible to fit the approximately cylindrically shaped cylindrical member 26 over the main body 25 through a seal ring and use cap nuts 27 to fasten the cylindrical member 26 to the outer circumferential surface of the main body 25 in a sealed state. The configuration using cap nuts of FIG. 6 and FIG. 7 is preferable because detaching the cap nuts and removing the main body makes it possible to easily clean the parts.

Next, referring to FIG. 5, the operation of the fluid mixer according to the second embodiment of the present invention will be explained.

If mixing water and a chemical from the upstream side of the fluid mixer and temporarily the concentration of the chemical becomes denser, the partially denser concentration flow of high concentration chemical will flow from the fluid inlet 12 into the first flow path 13. This high concentration chemical is divided through the communicating holes 10*c* to the first spiral flow path 20 and second spiral flow path 21. After the division, the high concentration chemical is divided from the first spiral flow path 20 and second spiral flow path 21 to the communicating holes 18, passes through the second flow path 15, and flows out from the fluid outlet 14. The high concentration chemical flows through the first spiral flow path 20 and the second spiral flow path 21 with a time difference, and is mixed there with the not denser concentration chemical. Due to this, in the same way as the first embodiment, it is possible to make the distribution of concentration of fluid in the flow direction uniform without unevenness.

In the fluid mixer of the present embodiment, the communicating holes 10*c* and 18 can be easily formed. The positions and the numbers of provision of the communicating holes 10*c* and 18 can be freely set. For this reason, it is possible to finely and evenly adjust the time difference in flows and possible to make the distribution of concentration of fluid in the flow direction finer and more uniform without any unevenness. Further, the fluid mixer of the present embodiment enables the flow paths to be formed comparatively easily despite the shapes of the flow paths being complicated and is small in number of parts as well, so it is possible to easily produce the fluid mixer. Furthermore, the flow path structure is kept compact, so the fluid mixer can be made small and the fluid mixer can be installed without taking up piping space. Further, couplings etc. can be connected to the fluid inlet 12 and fluid outlet 14 so as to enable the fluid mixer to be connected to an outside piping line, so the piping installation work is easy and connection to the piping line becomes possible in a short time period.

The communicating holes 18 are preferably formed so that the flow cross-sectional areas become approximately identical. Due to this, the flow rates of the fluid which is split by the communicating holes 18 become equal to each other, the fluid which flows into the fluid mixer is split substantially equally by the number of communicating holes 18 and merge and flow with a time difference from each other, and the distribution of concentration can be made uniform without any unevenness.

Note that, the fluid which flows through the first spiral flow path 29 and the second spiral flow path 30 flows out from the communicating holes 32 in a divided fashion whereby a pressure loss is caused. The flow rate at the downstream side of the first spiral flow path 29 and the second spiral flow path 30 is liable to reduce. Therefore, as shown in FIG. 7, the first spiral flow path 29 and the second spiral flow path 30 are preferably formed so that the flow cross-sectional areas gradually become smaller from first ends which are connected to the first flow path 31 toward the other ends. By gradually reducing the flow cross-sectional areas of the first spiral flow path 29 and the second spiral flow path toward the downstream side in the flow direction in this way, fluid can flow by a constant rate even if a pressure loss occurs. Therefore, the time difference between the divided flows of fluid can be stabilized. The flow cross-sectional areas of the first spiral flow path 29 and second spiral flow path 30 are gradually made smaller from the first ends connected to the first flow path 31 (fluid inlet 33 side) to the other ends (fluid outlet 34 sides). For this reason, in FIG. 7, the main body 25, where the height positions of the bottom surfaces of the spiral grooves are matched, is provided so that the outer circumferential surface of the main body 25 is gradually reduced in diameter from the fluid inlet 33 side toward the fluid outlet 34 side. The main body 25 fits with the cylindrical member 26, which is matched in shape with the outer circumferential surface, so as to form the first spiral flow path 29 and second spiral flow path 30. In addition, for example, it is also possible to form a spiral flow path so that the depth of the spiral groove which is provided in the main body 25 gradually becomes shallower from the fluid inlet 33 side toward the fluid outlet 34 side, possible to form a spiral flow path so that the width of the spiral groove gradually becomes narrower, or possible to form a spiral flow path by combining these.

Figure 7:
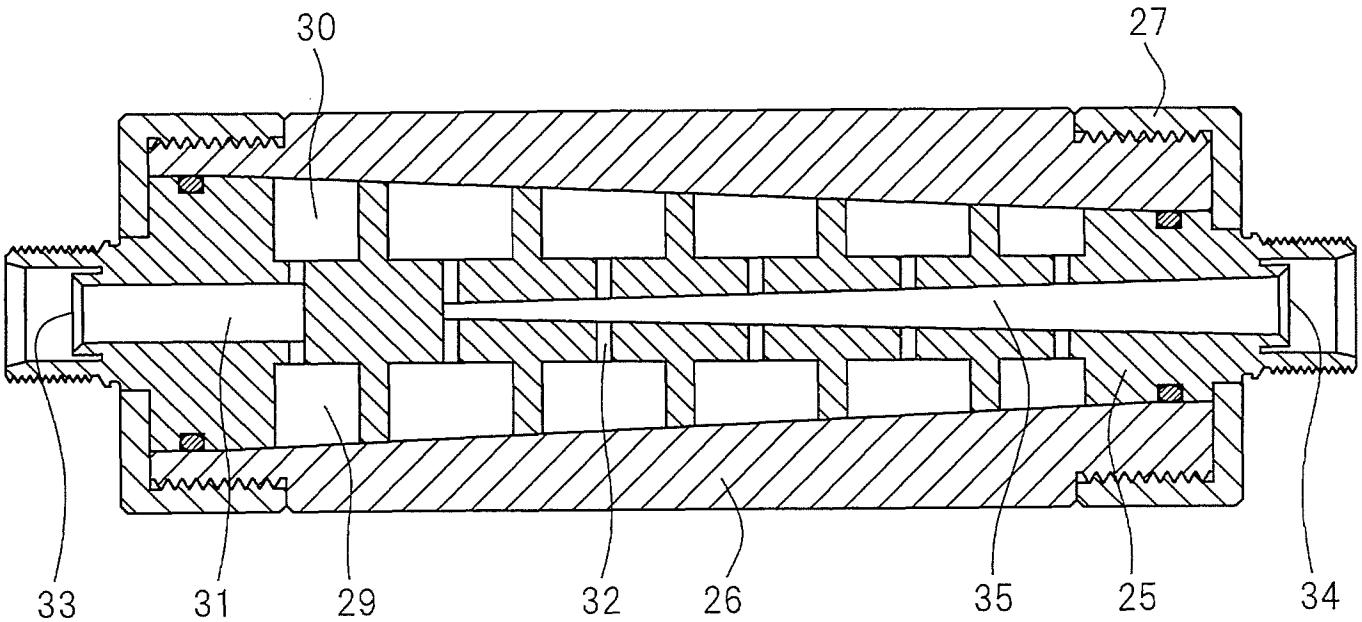
FIG. 7 is a longitudinal cross-sectional view which shows another modification of FIG. 5.

As shown in FIG. 7, the second flow path 35 is preferably formed so as to be gradually reduced in diameter from the fluid outlet 34 toward the upstream part (fluid inlet 33 side). Due to this, the fluid which flows from the first spiral flow path 29 and second spiral flow path 30 through the initial communicating holes 32 to the second flow path 35 is made to flow out most quickly through the second flow path 35 from the fluid outlet 34. The further downstream in the first spiral flow path 29 and second spiral flow path 30, gradually the slower the flow rate of the fluid which flows the second flow path 35 through the communicating holes 32 is made. Therefore, the time difference of the fluid which is split can be made clearer.

In the present embodiment, it is also possible to arrange a static mixer element inside the first flow path 31 or the second flow path 35 of the main flow path (not shown). The static mixer element is comprised of a plurality of twisted plates, which are twisted around the flow path axis by predetermined angles alternately reversed, coupled in series. The static mixer element enables the mixing effect of the fluid in the radial direction to be improved, so the effect of mixing in the flow direction and radial direction by the fluid mixer is augmented by the effect of mixing in the radial direction by the static mixer element. Therefore, the fluid can be mixed more uniformly. In particular, this is suitable when the fluid has viscosity and when mixing of the fluids is difficult.

Third Embodiment

Figure 8:
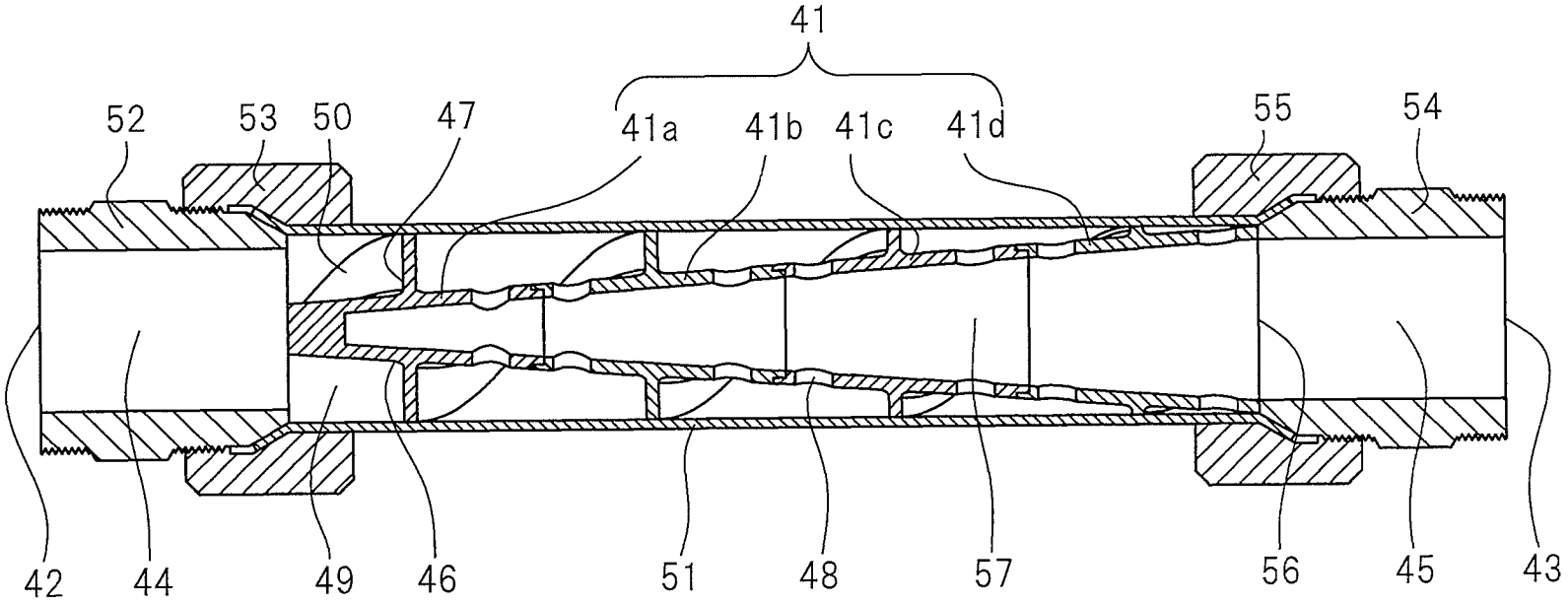
FIG. 8 is a longitudinal cross-sectional view which shows a fluid mixer according to a third embodiment of the present invention.
Figure 9A:
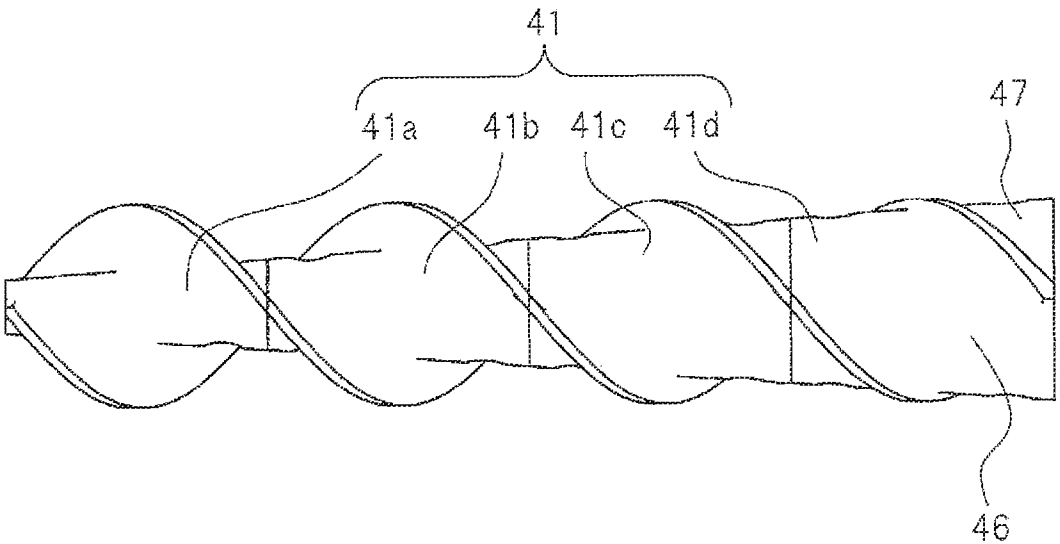
FIG. 9*a* is a left side view of a main body of FIG. 8.
Figure 9B:
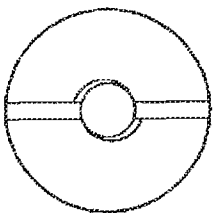
FIG. 9*b* is a front view of the main body of FIG. 8

Next, referring to FIG. 8 to FIG. 12, a fluid mixer according to a third embodiment of the present invention will be explained. FIG. 8 is a longitudinal cross-sectional view which shows the fluid mixer according to the third embodiment, FIG. 9*a* is a left side view which shows a main body of FIG. 8, and FIG. 9*b* is a front view which shows the main body of FIG. 8. In the third embodiment, a main body 41, a cylindrical member 51 which fit over the outer circumferential surface of the main body 41, and coupling members are used to form a fluid mixer which has a mixing flow path.

The main body 41 is made of PTFE (polytetrafluoroethylene). At the cylindrically shaped outer circumferential surface of the main body 41, a first spiral groove 46 and a second spiral groove 47 are formed. The depths of the first and second spiral grooves 46, 47 become gradually shallower from one end face to the other end side. The first spiral groove 46 and the second spiral groove 47 are the same shape as each other. The cross-sectional shapes of the spiral grooves 46 and 47 with respect to the flow path axis are the same as each other. These spiral grooves 46 and 47 are formed at a fixed interval in the axial direction, that is, offset in position (phase) from each other in the circumferential direction. Further, the first and second spiral grooves 46 and 47 are formed so that the grooves extend up to one end face and the grooves do not reach the other end face (see FIG. 9*a*). At the other end face of the main body 41, an opening 56 is formed. A conical space 57 which is gradually reduced in diameter the further toward the inside from the opening 56 is provided. At this time, the main body 41 is formed so that the thickness between the bottom surface of the first spiral groove 46 and the inner circumferential surface of the space 57 and the thickness between the bottom surface of the second spiral groove 47 and the inner circumferential surface of the space 57 become substantially equal. The bottom surfaces of the first spiral groove 46 and second spiral groove 47 form a conical shape reduced in diameter at the other end face side. Further, at predetermined positions in the circumferential direction from the bottom surfaces of the spiral grooves 46 and 47, a plurality of communicating holes 48 of approximately straight shapes, that is, straight or substantially straight shapes, are formed as branch flow paths communicating with the inner circumferential surface of the space 57. The communicating holes 48 positioned at the location which is nearest to the opening 56 side of the space 57 communicate with the opening 56 side end parts of the first spiral groove 46 and the second spiral groove 47.

The main body 41 is formed with a plurality of split members 41*a* to 41*d* coupled serially in the longitudinal direction. The split members 41*a* to 41*d* are split for every 180° turn of the first spiral groove 46 and second spiral groove 47 which are formed in the serially connected state about the longitudinal axis. The method of coupling the split members 41*a* to 41*d* need only enable coupling without the members deviating from each other. The method includes fitting, screwing, welding, melt bonding, bonding, etc. and is not particularly limited.

The cylindrical member 51 is a tube made of PFA and is formed in an approximately cylindrical shape, that is, a cylindrical shape or a substantially cylindrical shape. The inside diameter of the cylindrical member 51 is approximately the same as the outside diameter of the main body 41. The main body 41 is fit into the inside of the cylindrical member 51. By fitting the cylindrical member 51 inside the main body 41, the first spiral groove 46 of the main body 41 and the inner circumferential surface of the cylindrical member 51 form the first spiral flow path 49, while the second spiral groove 47 of the main body 41 and the inner circumferential surface of the cylindrical member 51 form the second spiral flow path 50. At both end faces of the cylindrical member 51, coupling members comprised of connectors 52 and 54 and fastening nuts 53 and 55 are connected. By inserting first ends of the connectors 52 and 54 in both ends of the cylindrical member 51 and fastening them by the fastening nuts 53 and 55, the main body 41 is fastened between the connectors 52 and 54 of the coupling members. In this case, connection of the coupling members to both ends of the cylindrical member 51 forms the housing.

Inside the fluid mixer comprised of the main body 41 at the outer circumference of which the housing is fit, the first flow path 44 and the second flow path 45 used as the main flow path are provided separated from each other on the center axis of the fluid mixer. At the end face of the connector 52 of one coupling member, a fluid inlet 42 is provided. Inside of the connector 52, the first flow path 44 which communicates with the fluid inlet 42 is formed. The connector 52 is connected to the opposite side of the main body 41 from the opening 56 side. The first flow path 44 communicates with the ends of the first spiral flow path 49 and the second spiral flow path 50. That is, in FIG. 8, the first flow path 44 directly communicates with the spiral flow paths 49 and 50 without going through the communicating flow paths (10*a* and 10*b* in FIG. 1). At the end face of the connector 54 of the other coupling member, a fluid outlet 43 is provided. The connector 54 is connected to the main body 41 at the opening 56 side. The inside of the connector 54 and the space 57 of the main body 41 form the second flow path 45 which communicates with the fluid outlet 43. In the third embodiment, the operation in the point that the distribution of concentration of the fluid in the flow direction is made uniform without any unevenness is similar to the first embodiment, so the explanation will be omitted.

Note that, the cylindrical member 51 may be formed by something other than a soft member like a tube. For example, it may be formed by a hard member like a pipe. That is, it is not particularly limited so long as a cylindrical shape with an inside diameter which is approximately the same as the outside diameter of the main body 41 and a shape with which the main body 41 fits. In the third embodiment, the connectors 52 and 54 and fastening nuts 53 and 55 are used to form coupling members which are connected to both ends of the cylindrical member 51. However, so long as shapes which can connect to both ends of the cylindrical member 51 to arrange in piping lines and can fasten the main body 41, the coupling members are not particularly limited in configuration and may include sockets, reducers, union couplings, flanges, etc. Further, the method of connecting the coupling members and the cylindrical member 51 is not particularly limited and may include screwing, bonding, welding, melt bonding, bolting, pinning, clamping, bayoneting, etc.

In this way, in the third embodiment, by just setting the main body 41 inside the tubular housing, the flow path of the fluid mixer is formed. It is possible to use an existing tube, pipe, etc. which is used in piping lines as a member of the housing. Further, it is possible to change the method of connection with the piping or the configuration of the couplings of the fluid mixer in accordance with the situation of the piping line. This enables broad use in accordance with the situation. Further, in the fluid mixer of the present embodiment, it is possible to secure the volume of the flow path to the maximum extent, so it is possible to run a large flow of fluid. Furthermore, compared with the second embodiment, the dimensional difference between the inside diameter of the fluid inlet 42 and the outside diameter of the cylindrical member 51 and the dimensional difference between the inside diameter of the fluid outlet 43 and the outside diameter of the cylindrical member 51 is small. The fluid mixer is not made that larger compared with the opening of the piping line to be connected with, so the fluid mixer can be configured compactly. For this reason, in particular in a large sized fluid mixer, installation is possible without taking up a lot of installation space, so the apparatus is preferable.

The main body 41 in the present embodiment is comprised of split members 41*a* to 41*d* serially coupled together. However, it may also be formed by a single member. When using split members 41*a* to 41*d* to configure the main body 41, the number of split members 41*a* to 41*d* which are coupled may be two or more. Further, although the sizes into which the split members 41*a* to 41*d* are split are not particularly limited, making them the same sizes is preferable since it facilitates manufacture. For example, it is possible to split them every 180° turn of the plurality of spiral grooves 46 and 47 around the longitudinal axis or split them every 360° turn. Communicating holes 48 which are provided at the individual split members 41*a* to 41*d* may be provided at any locations depending on the conditions for mixing the fluid so long as communicating the bottom surfaces of the plurality of spiral grooves 46 and 47 and the inner circumference of the space 57. The set positions of the communicating holes 48 may be changed according to the split members 41*a* to 41*d* as well.

In the third embodiment, at the circumferences of the split members 41*a* to 41*d*, a plurality of spiral grooves with directions of spirals constantly in the forward direction with respect to the axial direction are formed. However, as shown in FIG. 10, it is also possible to alternately couple split members 64*b* and 64*d* with directions of spirals in the forward direction with respect to the flow path axis and split members 64*a* and 64*c* with directions in the reverse direction. In this case, the fluid alternately swirls in the forward and reverse directions when flowing through the first and second spiral grooves 62 and 63 of the main body 64, so a similar effect is obtained as with shaking and mixing the fluid inside the first and second spiral grooves 62 and 63. The fluid which flows through the first and second spiral grooves 62 and 63 is agitated in the radial direction.

Figure 11:
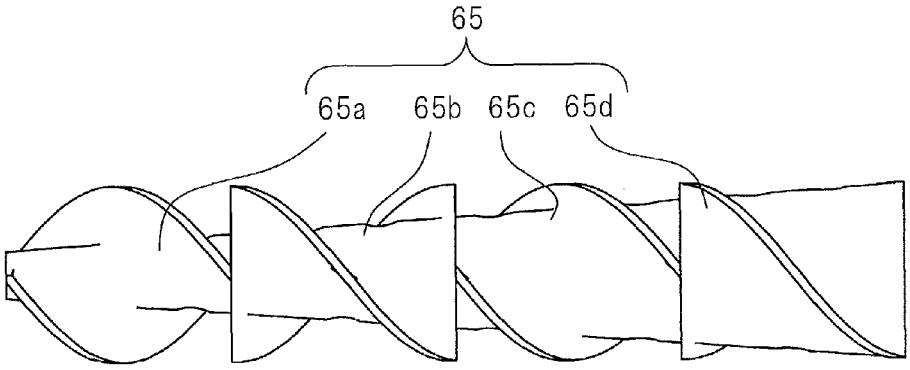
FIG. 11 is a view which shows a modification of FIG. 10.

Further, the main body may be formed by coupling the split members 65*a* to 65*d* while rotating by 90 degree to offset with respect to the axis, so as to change it from the state of FIG. 9 to the state of FIG. 11. In a fluid mixer which uses such a main body 65, the spiral flow paths communicate in the middle, so the fluids which flow through the spiral flow paths are mixed and divided every time passing through the split members. More specifically, when the fluid which flowed through the first spiral path of the first-order split member flows through the second-order split member, it is split between the first spiral flow path and the second spiral flow path. Similarly, when the fluid which flowed through the second spiral path of the first-order split member flows through the second split member, it is split between the first spiral flow path and the second spiral flow path. The split flows of fluid merge and mix, then are further split and mixed by the third-order and following split members on a repeated basis, so the fluid is more uniformly agitated in the radial direction. It is also possible to couple the split members by turning them 90 degrees with respect to the axis from the state of FIG. 10 (not shown). In this case, the synergistic effect between agitation of the fluid due to the swirling in the forward and reverse direction and agitation due to repeated splitting and mixing enables the fluid to be more uniformly agitated with respect to the radial direction. For this reason, it is possible to simultaneously mix the fluid in the flow direction and the radial direction by just the fluid mixer, so this is preferable. Here, in the case of the configuration such as in FIG. 11, if the split members 65*a* to 65*d* are split for every 180° or more spiral turn of the first and second spiral grooves about the longitudinal axis, when the fluid flows through the spiral flow paths of the split members 65*a* to 65*d*, the fluid will always strike the side walls of the spiral grooves. Therefore, the agitating effect can be enhanced, so this is preferred. When the number of spiral grooves is two or more, if the number of the plurality of spiral grooves is "n", it is sufficient for the main body to be split for every 360°/n or more spiral turn about the longitudinal axis.

Figure 12A:
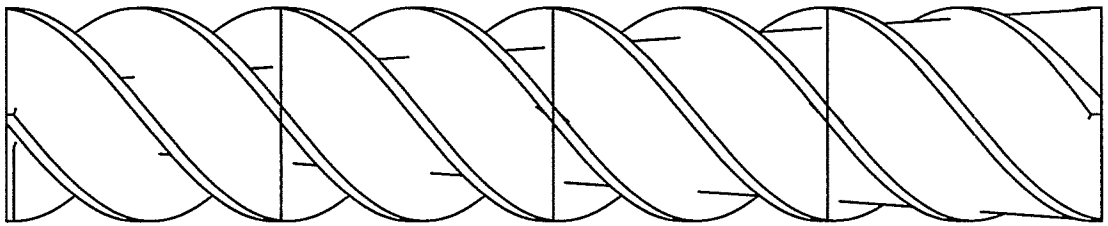
FIG. 12*a* is a view which shows a modification of FIG. 9*a*.
Figure 12B:
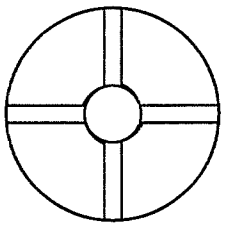
FIG. 12*b* is a view which shows a modification of FIG. 9*b*.

If coupling a plurality of split members to form a main body in this way, working and shaping of the individual split members become easy and it is possible to freely combine cases of forming the spiral flow paths in fixed directions, cases of forming them so as to be alternately opposite in directions, etc. in accordance with the situation, so this is preferable. Note that, the main body may also be formed with two or more spiral grooves. FIG. 12*a* and FIG. 12*b* are a side view and a front view of the case of forming four spiral grooves. As illustrated, by providing the main body 65 with spiral grooves, cross-shaped cross-sectional walls (see FIG. 12*b*) are formed.

Fourth Embodiment

Figure 13:
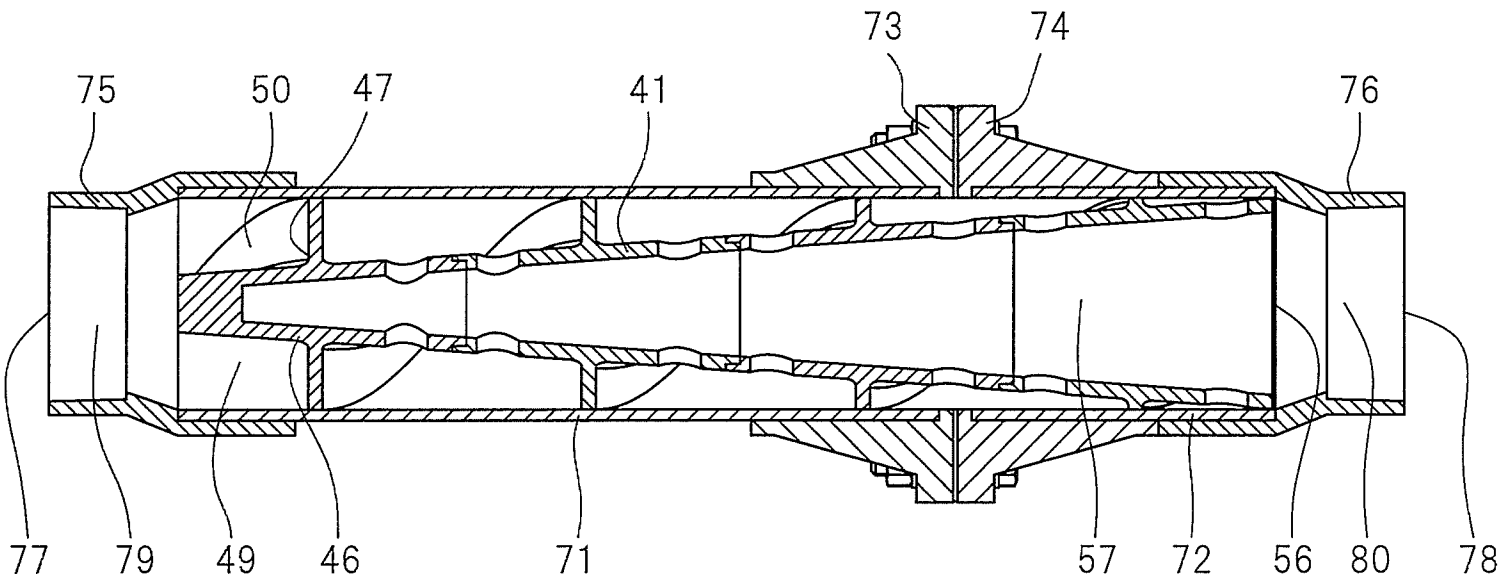
FIG. 13 is a longitudinal cross-sectional view which shows a fluid mixer according to a fourth embodiment of the present invention.

Next, referring to FIG. 13, a fluid mixer according to a fourth embodiment of the present invention will be explained. FIG. 13 is a longitudinal cross-sectional view which shows the fluid mixer according to the fourth embodiment. The fluid mixer according to the fourth embodiment has a main body 41, a pair of cylindrical members which cover the surroundings of the main body 41 (a first cylindrical member 71 and a second cylindrical member 72), flanges 73 and 74 which are connected to the cylindrical member, and coupling members.

The first cylindrical member 71 is comprised of a pipe made from PVC (polyvinyl chloride). One end of the first cylindrical member 71 is inserted into one end of a coupling member constituted by a reducer 75 and is connected to the reducer 75 by bonding. The other end of the first cylindrical member 71 is inserted into the flange 73 and is connected to the flange 73 by bonding. The second cylindrical member 72 is comprised of a pipe made from PVC. One end of the second cylindrical member 72 is inserted into one end of a coupling member constituted by a reducer 76 and is connected to the reducer 76 by bonding. The other end of the second cylindrical member 72 is inserted into the flange 74 and is connected to the flange 74 by bonding.

The main body 41 is housed from the openings of the flange 73 and 74 sides to the insides of the first cylindrical member 71 and second cylindrical member 72. The flanges 73 and 74 are connected by bolts and nuts. Due to this, the main body 41 is fastened between the reducers 75 and 76 as the coupling members. The first cylindrical member 71, second cylindrical member 72, flanges 73 and 74, and reducers 75 and 76 are connected to form the housing. By fitting the first cylindrical member 71 and second cylindrical member 72 over the main body 41, the first spiral groove 46 of the main body 41 and the inner circumferential surfaces of the first and second cylindrical members 71 and 72 form the first spiral flow path 49, while the second spiral groove 47 of the main body 41 and the inner circumferential surfaces of the first and second cylindrical members 71 and 72 form the second spiral flow path 50. The configuration of the main body of the fourth embodiment is similar to the third embodiment, so the explanation will be omitted.

Inside of the fluid mixer, which is comprised of the main body 41 at the outer circumference of which a housing is fit, a first flow path 79 and a second flow path 80 as a main flow path are provided separated from each other on the center axis of the fluid mixer. At the end face of the reducer 75 of the coupling member which is connected to the first cylindrical member 71, a fluid inlet 77 is provided. The inside of the reducer 75 forms the first flow path 79 which communicates with the fluid inlet 77. The reducer 75 is connected to the main body 41 at the opposite side opening from the opening 56. The first flow path 79 communicates with the ends of the first spiral flow path 49 and the second spiral flow path 50. The end face of the reducer 76 of the coupling member which is connected to the second cylindrical member 72 is provided with a fluid outlet 78. The reducer 76 is connected with the opening 56 side of the main body 41. The inside of the reducer 76 and the space 57 of the main body 41 form the second flow path 80 which communicates with the fluid outlet 78. In the fourth embodiment, the operation in the point that the distribution of concentration in the flow direction of the fluid is made uniform without any unevenness is similar to the first embodiment, so the explanation will be omitted.

In the fourth embodiment, it is possible to detach the bolts and nuts of the flanges and separate the first cylindrical member and the second cylindrical member so as to take out the main body and thereby possible to easily clean the parts.

Fifth Embodiment

Figure 14:
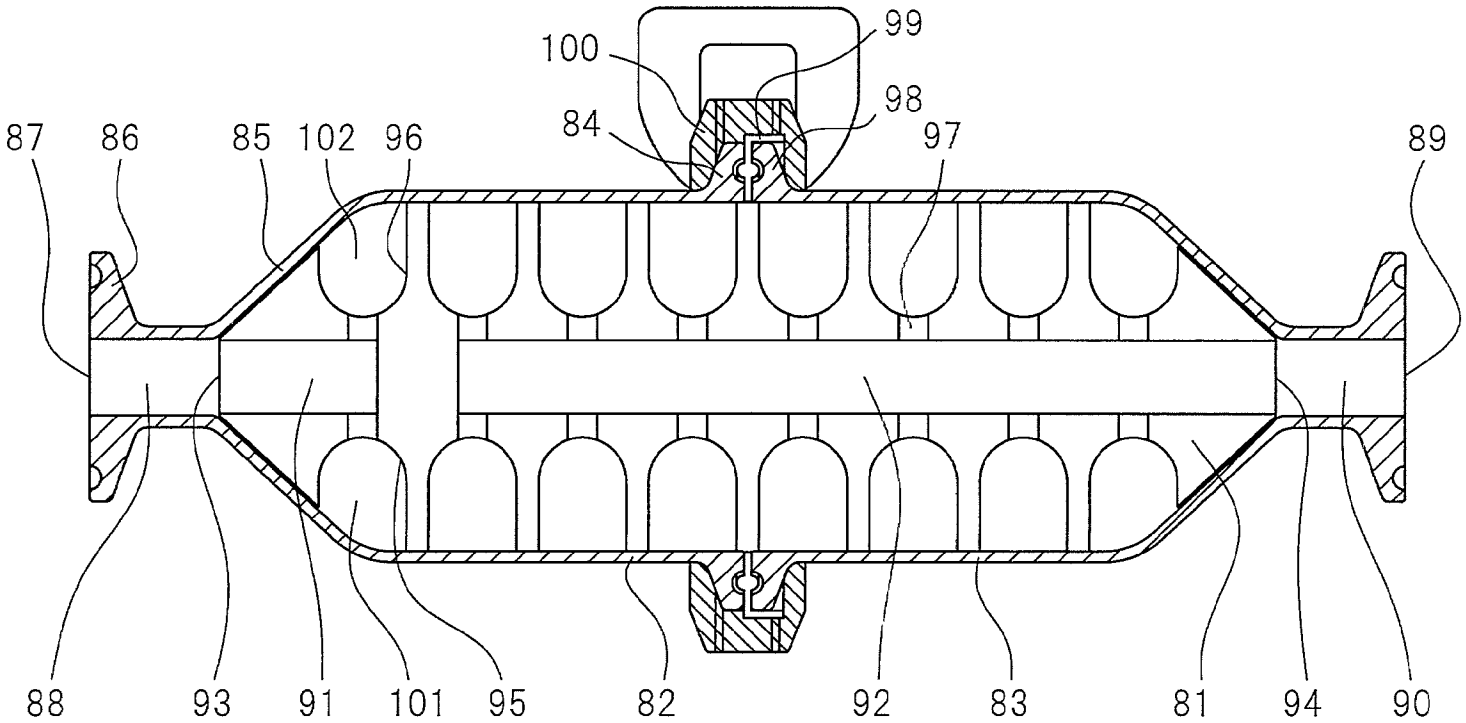
FIG. 14 is a longitudinal cross-sectional view which shows a fluid mixer according to a fifth embodiment of the present invention.

Next, referring to FIG. 14, a fluid mixer according to a fifth embodiment of the present invention will be explained. FIG. 14 is a longitudinal cross-sectional view which shows the fluid mixer according to the fifth embodiment and shows a fluid mixer of a shape which uses ferrule couplings. This fluid mixer has an approximately cylindrically shaped main body 81 and a pair of cylindrical members (a first cylindrical member 82 and a second cylindrical member 83) which cover the surroundings of the main body 81.

The main body 81 and the pair of cylindrical members 82 and 83 are, for example, comprised of stainless steel (SUS304 etc.) Note that, the first cylindrical member 82 and the second cylindrical member 83 are the same shape as each other, so below mainly the first cylindrical member 82 will be used as the representative case to explain the configuration of the fluid mixer. At the outer circumference of one end of the first cylindrical member 82, a flange 84 is provided, while at the other end, a reduced diameter part 85 with a cylindrical part which is reduced in diameter is provided. At the reduced diameter end of the reduced diameter part 85, a ferrule coupling part 86 is provided. The end face of the ferrule coupling part 86 is provided with an inlet opening 87. The inlet opening 87 communicates with an inlet flow path 88 of the inside of the first cylindrical member 82. Note that, the end face of the ferrule coupling part of the second cylindrical member 83 is provided with an outlet opening 89. The outlet opening 89 communicates with the outlet flow path 90 of the inside of the second cylindrical member 83.

Inside of the main body 81, a first flow path 91 and a second flow path 92 are provided separated from each other on the same axis. One end face of the main body 81 is provided with a fluid inlet 93 which communicates the inlet flow path 88 and the first flow path 91, while the other end face is provided with a fluid outlet 94 which communicates the outlet flow path 90 and second flow path 92. The outer circumferential surface of the main body 81 is formed with a first spiral groove 95 and second spiral groove 96 with bottom surfaces of substantially arc shapes. The first spiral groove 95 and the second spiral groove 96 are the same shape as each other. The cross-sectional shapes of the spiral grooves 95 and 96 with respect to the flow path axis are the same as each other. These spiral grooves 95 and 96 are formed at a set interval in the axial direction, that is, offset in position from each other in the circumferential direction. First ends of the first spiral groove 95 and the second spiral groove 96 are connected to the first flow path 91. At predetermined positions in the circumferential direction from the bottom surfaces of the first and second spiral grooves 95 and 96 to the inner circumference of the second flow path 92, a plurality of straight shaped communicating holes 97 are formed which communicate the first spiral groove 95 and second spiral groove 96 and the first flow path 91. The communicating holes 97 which are positioned at the location which is nearest to the fluid inlet 93 side communicate with first ends of the first spiral groove 95 and the second spiral groove 96, while the communicating holes 97 which are positioned at the location which is nearest to the fluid outlet 94 side communicate with the other ends of the first spiral groove 95 and second spiral groove 96.

The both ends of the main body 81 are shaped reduced in diameter to match the inner circumferences of the first and second cylindrical members 82 and 83. The outer circumference of the main body 81 is approximately the same diameter as the inner circumferences of the first and second cylindrical members 82 and 83. The main body 81 is inserted from the openings of the flanges 84 and 98 at the sides of the first and second cylindrical members 82 and 83 not reduced in diameter. Between the end faces of the flanges 84 and 98, a gasket 99 is gripped. The flanges 84 and 98 are coupled by a clamp 100. In the configuration of this FIG. 14, the first and second cylindrical members 82 and 83 form the housing, while the first and second cylindrical members 82 and 83 and the inner circumferential surfaces of the first spiral groove 95 and the second spiral groove 96 form the first spiral flow path 101 and the second spiral flow path 102.

Note that, the flanges 84 and 98 of the present embodiment are connected in the same way as the method of connection of the ferrule couplings. Ferrule couplings may also be used. Even in a state other than that which is shown in FIG. 14, ferrule couplings can be used to form a fluid mixer by easy assembly. For example, it is possible to fit the main body in a cylindrically shaped housing which is provided with ferrule coupling parts on both ends (not shown).

In the fifth embodiment, the operation in the point that the distribution of concentration of the fluid in the flow direction is made uniform without any unevenness is similar to the first embodiment, so the explanation will be omitted. The fluid mixer of the present embodiment is easy to disassemble and assemble, so the ferrule coupling parts 86 can be used to easily attach and detach it to and from a piping line. In the disassembled state, the main body 81 is formed with first and second spiral grooves 95 and 96 at its outer circumference and is formed with straight shaped first and second flow paths 91 and 92 at its inside for a simple, complication-free structure, so can be easily and reliably cleaned. Further, the bottom surfaces of the first and second spiral grooves 95 and 96 are approximately arc shaped, so solid matter can be prevented from building up at the bottoms of the first and second spiral grooves 95 and 96 and even the tight corners can be easily cleaned. Therefore, this can be preferably used in the food field where work of disassembling and cleaning parts then reassembling them is performed particularly frequently.

Sixth Embodiment

Figure 15:
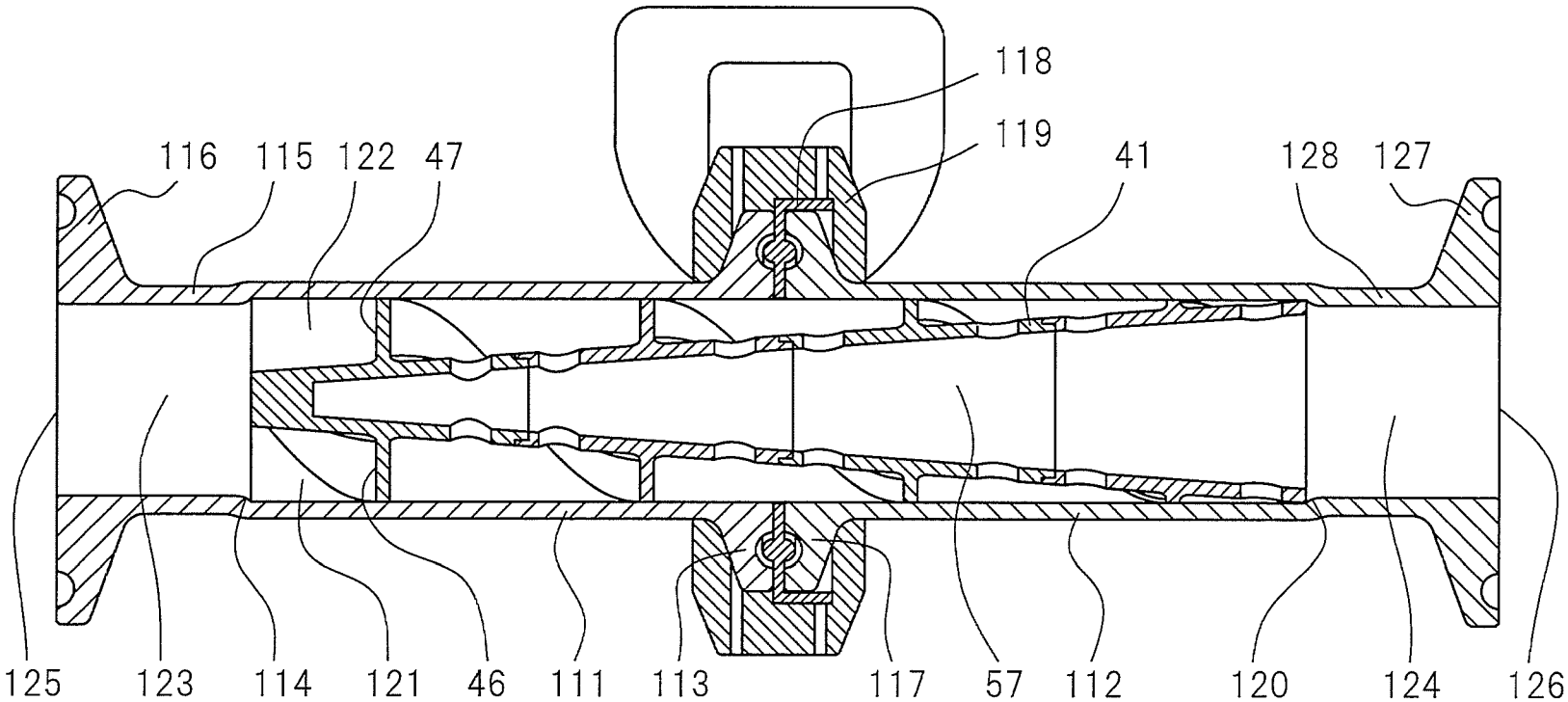
FIG. 15 is a longitudinal cross-sectional view which shows a fluid mixer according to a sixth embodiment of the present invention.

Next, referring to FIG. 15, a fluid mixer of a sixth embodiment of the present invention will be explained. FIG. 15 is a longitudinal cross-sectional view which shows the fluid mixer of the sixth embodiment and shows a fluid mixer of a shape in which ferrule couplings are used. This fluid mixer has an approximately cylindrically shaped main body 41 and a pair of cylindrical members (a first cylindrical member 111 and a second cylindrical member 112) which cover the surroundings of the main body 41.

The main body 41 and the pair of cylindrical members 111 and 112 are, for example, comprised of stainless steel (SUS304 etc.) Note that, the first cylindrical member 111 and the second cylindrical member 112 are the same shape, so below mainly the first cylindrical member 111 will be used as the representative case to explain the configuration of the fluid mixer. At the outer circumference of one end of the first cylindrical member 111, a flange 113 is provided, while at the other end, a ferrule coupling part 116 is provided. At the inner circumference of the other end of the first cylindrical member 111, a step difference 114 is provided. A pipeline 115 is laid from the step difference 114 to the opening at the other end face side. The main body 41 is inserted into the openings of the flanges 113 and 117 of the first cylindrical member 111 and second cylindrical member 112. Between the end faces of the flanges 113 and 117, a gasket 118 is gripped. The flanges 113 and 117 are coupled by a clamp 119. At this time, the first and second cylindrical members 111 and 112 form the housing, and the main body 41 is fastened between the step differences 114 and 120 of the first and second cylindrical members 111 and 112. By fitting the main body 41 with the first cylindrical member 111 and second cylindrical member 112, the first spiral groove 46 of the main body 41 and the inner circumferential surfaces of the first and second cylindrical members 111 and 112 form the first spiral flow path 121, while the second spiral groove 47 of the main body 41 and the inner circumferential surfaces of the first and second cylindrical members 111 and 112 form the second spiral flow path 122. The main body of the sixth embodiment is configured similar to the third embodiment, so the explanation will be omitted.

At the inside of the fluid mixer comprised of the main body 41 at the outer circumference of which the housing is fit, the first flow path 123 and the second flow path 124 which form the main flow path are provided separated from each other on the center axis of the fluid mixer. At the end face of the first cylindrical member 111 at the ferrule coupling part 116 side, a fluid inlet 125 is provided. The inner circumferential surface of the first cylindrical member 111 is formed with the first flow path 123 which communicates with the fluid inlet 125. The first flow path 123 is formed inside the pipeline 115 at the end of the first cylindrical member 111, that is, inside of the pipeline 115 from the step difference 114 of the first cylindrical member 111 to the fluid inlet 125, and communicates with the first spiral flow path 121 and the second spiral flow path 122. At the end face of the second cylindrical member 112 at the ferrule coupling part 127 side, a fluid outlet 126 is provided. The second flow path 124 is formed at the space 57 of the main body 41 and inside of the pipeline 128 at the end of the second cylindrical member 112, that is, at the space 57 and the inside of the pipeline 128 from the step difference 120 of the second cylindrical member 112 to the fluid outlet 126, and communicates with the fluid outlet 126. In the sixth embodiment, the operation in the point that the distribution of concentration in the flow direction of the fluid is made uniform without any unevenness is similar to the first embodiment, so the explanation will be omitted.

Next, the apparatus using the above fluid mixer will be explained with reference to FIG. 16 and FIG. 17. The fluid mixer according to this embodiment of the present invention is applied to the inside of a line where, for example, the temperature or concentration of the fluid changes along with time. That is, for example, it is applied to the case where a heater is installed in the line and the temperature of the fluid which is heated by this heated fluctuates with respect to the time axis and thereby the temperature of the fluid changes along with time or the case where the eluted concentration changes along with time in a line which dissolves a solid immersed in a tank in a fluid and runs the same, etc. In this case, by using the fluid mixer according to the present embodiment, it is possible to make the temperature or concentration of the fluid in the line uniform. Note that, the substance which flows as a fluid is not limited so long as being a gas or liquid.

Figure 16:
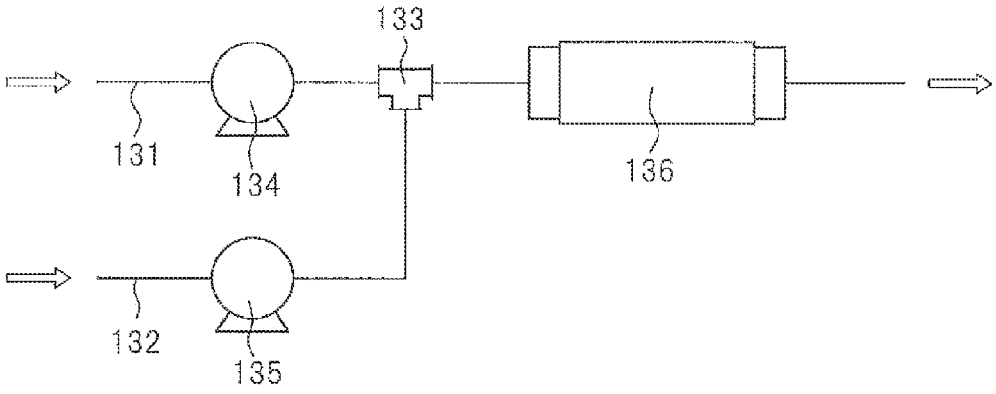
FIG. 16 is a schematic view which shows an embodiment of an apparatus in which the fluid mixer of the present invention is used.

FIG. 16 is a view which shows one example of an apparatus which uses a fluid mixer according to the present embodiment. In the figure, the fluid mixer 136 according to the present embodiment is arranged at the downstream side of a merging part 133 of the lines 131 and 132 through which two substances flow. The substances are supplied from pumps 134 and 135. Therefore, the pulsation of the pumps 134 and 135 etc. sometimes cause the mixing ratio when the fluids merge to change over time. In this case, the fluid mixer 136 may be used to make the mixing ratio of the substances uniform and thereby make the temperature or concentration constant with respect to the time axis. Note that, this is also effective, for example, in the case where, when a high temperature fluid and a low temperature fluid flow through the lines 131 and 132, the high temperature fluid flows unevenly and the temperature of the fluid fluctuates over the time axis or in the case where, when a fluid of a fixed concentration is mixed with another fluid, the concentration of the mixed fluid changes along with time, etc. The fluid at this time may be any of a gas, liquid, solid, powder, etc. A solid or powder may be mixed with a gas or liquid in advance. Note that it is also possible to configure the apparatus to make lines carrying three or more substances to merge, so that three or more substances are mixed by the fluid mixer.

Figure 17:
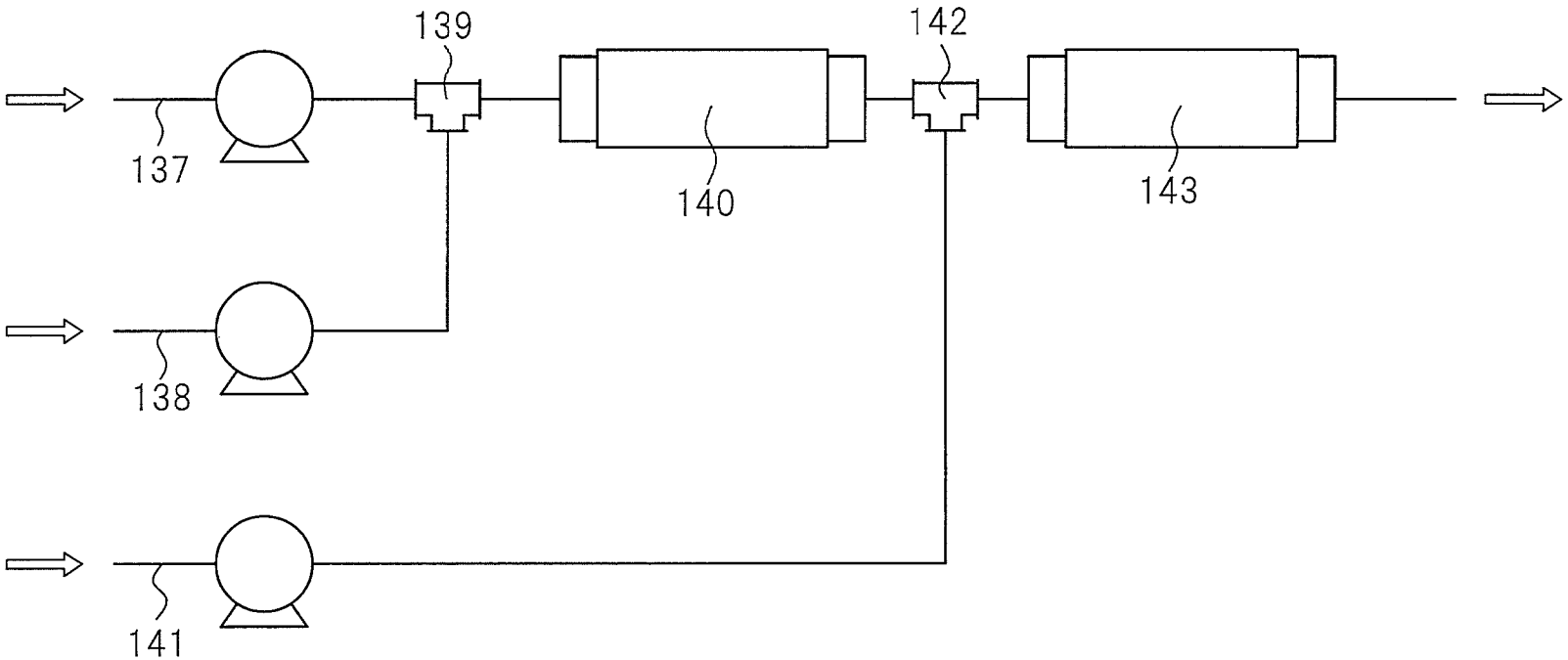
FIG. 17 is a schematic view which shows another embodiment of an apparatus in which the fluid mixer of the present invention is used.
Figure 18:
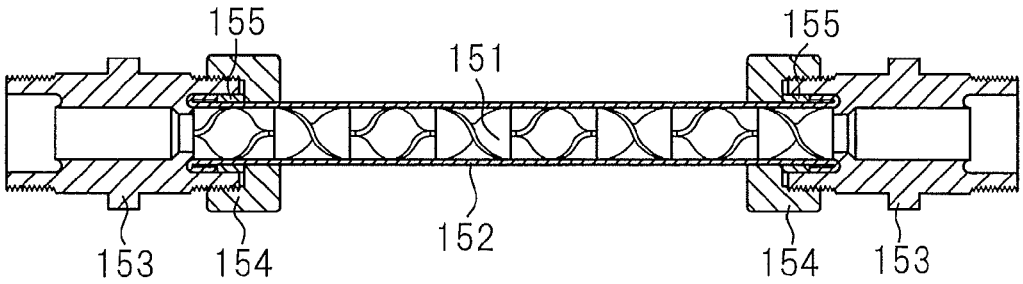
FIG. 18 is a longitudinal cross-sectional view which shows a conventional static mixer.
Figure 19A:
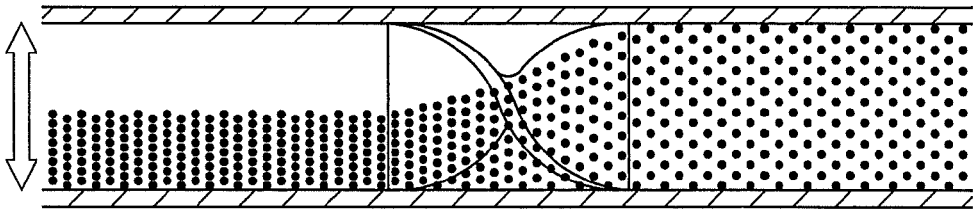
FIG. 19*a* is a schematic view which shows a state of agitation of fluid according to the static mixer of FIG. 18.
Figure 19B:
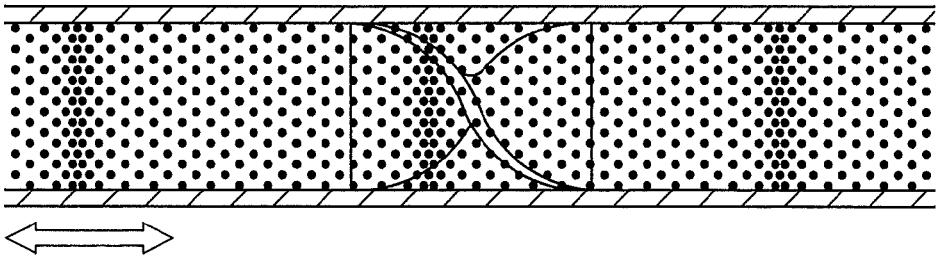
FIG. 19*b* is a schematic view which shows a state of agitation of fluid according to the static mixer of FIG. 18.

FIG. 17 is a view which shows a modification of FIG. 16. In FIG. 17, a fluid mixer 140 according to the present embodiment is arranged at the downstream side of the merging part 139 of lines 137 and 138 through which two substances flow. Further, a merging part 142 at which a line 141, through which another substance flows, merges is provided at the downstream side of the fluid mixer 140, and a fluid mixer 143 according to the present embodiment is also arranged at the downstream side of the merging part 142. Therefore, if uneven mixing would occur when simultaneously mixing three or more substances, it is possible to make the two substances mixed first uniform, then mix in the other substance and make the mixture uniform and possible to efficiently uniformly mix the substances without uneven mixing. For example, when mixing water, oil, and a surfactant, if mixing everything at one time, uneven mixing will occur without good mixing. However, it is possible to mix the water and surfactant in advance, then mix in the oil so as to uniformly mix the substances without unevenness. It is also possible to suitably use this to mix water with sulfuric acid for dilution, then mix ammonia gas with the mixture to cause the ammonia gas to be absorbed or to mix water with sulfuric acid for dilution, then mix sodium silicate with the mixture to adjust the pH. Note that, it is also possible to first mix three or more substances or two merge two or more substances in the middle. Further, it is also possible to arrange three or more fluid mixers in series and mix in other substances in stages.

Combinations of different types of fluids which are mixed by the present apparatus will be further explained. In the apparatus of FIG. 16, it is possible to run water through the line 131 through which one substance flows and a pH adjuster, liquid fertilizer, bleach, bactericide, surfactant, or liquid chemical through the line 132 through which the other substance flows.

In this case, the water may be pure water, distilled water, tap water, industrial water, etc. It is not particularly so long as meeting the conditions of the substance to be mixed with. Further, the temperature of the water is also not particularly limited. Warm water or cold water may be used. The pH adjuster need only be an acid or alkali used for adjusting the pH of the liquids to be mixed. Hydrochloric acid, sulfuric acid, nitric acid, fluoric acid, carbonic acid, citric acid, gluconic acid, succinic acid, potassium carbonate, sodium hydrogen carbonate, sodium hydroxide aqueous solution, etc. may be mentioned. The liquid fertilizer may be any liquid fertilizer for agricultural use. Manure or a chemical fertilizer etc. may be mentioned.

The bleach may be any one which utilizes the oxidation and reduction reaction of a chemical substance to break down color. Sodium hypochlorite, sodium percarbonate, hydrogen peroxide, ozone water, thiourea dioxide, etc. may be mentioned. A bactericide is a chemical for killing microorganisms having pathogenicity or toxicity. An iodine tincture, povidone iodine, sodium hypochlorite, chloride of lime, mercurochrome, chlorhexidine gluconate, acrinol, ethanol, isopropanol, hydrogen peroxide aqueous solution, benzalkonium chloride, cetylpyridinium chloride, saponated cresol solution, sodium chlorite, hydrogen peroxide, sodium hypochlorite, hypochlorous acid water, ozone water, etc. may be mentioned.

The surfactant is a substance having parts in the molecule with affinity with water (hydrophilic groups) and parts with affinity with oil (lyophilic groups and hydrophobic groups). A fatty acid sodium salt, fatty acid potassium salt, monoalkyl sulfuric acid salt, alkyl polyoxyethylene sulfuric acid salt, alkylbenzene sulfonic acid salt, monoalkyl phosphoric acid salt, alkyltrimethyl ammonium salt, dialkyldimethyl ammonium salt, alkylbenzyl dimethyl ammonium salt, alkyldimethylamine oxide, alkylcarboxybetaine, polyoxyethylene alkyl ether, fatty acid sorbitan ester alkylpolyglucoside fatty acid diethanolamide, alkylmonoglyceryl ether, α-sulfofatty acid ester sodium salt, linear alkylbenzenesulfonic acid sodium salt, alkylsulfonic acid ester sodium salt, alkylether sulfonic acid ester sodium salt, α-olefin sulfonic acid sodium salt, alkyl sulfonic acid sodium salt, sucrose fatty acid ester sorbitan fatty acid ester, polyoxyethylene sorbitan fatty acid ester, fatty acid alkanolamide, polyoxyethylene alkyl ether, polyoxyethylene alkyl phenyl ether, alkyl amino fatty acid sodium salt, alkylbetaine, alkylaminoxide, alkyltrimethyl ammonium salt, dialkyldimethyl ammonium salt, etc. may be mentioned.

Further, so long as within the range of liquid chemicals, a liquid chemical which does not fall under the above categories may also be used. Hydrochloric acid, sulfuric acid, acetic acid, nitric acid, formic acid, fluoric acid, sodium hydroxide, potassium hydroxide, calcium hydroxide, barium hydroxide, ammonium hydroxide, sodium silicate, oil, etc. may be mentioned. Note that, the liquid chemicals mentioned here are also used chemicals corresponding to the above categories. Further, it is also possible to run cold water through the line 131 through which one substance flows and hot water through the line 132 through which the other substance flows and to mix the cold water and hot water to give a uniform, constant temperature.

Further, it is also possible to run a first liquid chemical through the line 131 through which one substance flows and a second liquid chemical or metal through the line 132 through which the other substance flows and mix these by the fluid mixer 136. The first and second liquid chemicals to be mixed here may be any liquid chemicals which can be mixed. The above liquid chemicals or other liquid chemicals may also be used. For example, photoresist and thinner etc. may be mentioned. Further, the liquid chemical may also be a cosmetic. As the cosmetic, a facial cleanser, cleansing solution, toilet water, beauty essence, milky lotion, cream, gel, or other such foundation cosmetic aimed at preparing the skin itself or medicinal use and other products, corresponding to "quasi drugs" in Japan, aimed at preventing bad breath, body odor, heat rashes, sores, hair loss, etc., at promoting hair growth or removing hair, driving away mice or insects, etc. may be mentioned.

The metal is mainly an organometallic compound and is used as fine granules, a powder, or as a liquid obtained by dissolution in an organic solvent etc. As the organometallic compound, organozinc compounds such as chloro(ethoxycarbonylmethyl) zinc, organocopper compounds such a lithium dimethyl cuprate, Grignard reagents, organomagnesium compounds such as iodo(methyl) magnesium and diethyl magnesium, organolithium compounds such as n-butyl lithium, metal carbonyl, carbene complexes, ferrocene and other metallocenes and other organometallic compounds, single element or multiple element mixed standard solutions dissolved in paraffin oil, etc. may be mentioned. Further, silicon, arsenic, boron, and other semimetal compounds or aluminum or other such base metals are included. The organic metal compound is suitably used as a catalyst in the production of a petrochemical product or the production of an organic polymer.

Further, it is also possible to run a waste liquid through the line 131 through which one substance flows and a pH adjuster or flocculant through the line 132 through which the other substance flows and mix these by the fluid mixer 136. The pH adjuster used may be the above pH adjuster. The flocculant is not particularly limited so long as causing flocculation of the waste liquor. Ammonium sulfate, polyferrous sulfate, polyaluminum chloride, polysilica iron, calcium sulfate, ferrous chloride, slaked lime, etc. may be mentioned. The microorganism need only be one which promotes fermentation or breakdown of waste liquor. A mold, yeast, or other fungi, bacteria or other microorganisms etc. may be mentioned.

Further, it is possible to run a first petroleum oil through the line 131 through which one substance flows and a second petroleum oil, additive, or water through the line 132 through which the other substance flows and mix these by the fluid mixer 136. Here, the "first and second petroleum oils" mean liquid oils having hydrocarbons as main ingredients and also containing small amounts of sulfur, oxygen, nitrogen, and various other substances. Naphtha (gasoline), kerosine, diesel oil, heavy oil, lubricating oil, asphalt, etc. may be mentioned. The "additive" referred to here indicates something which is added to improve or maintain the quality of petroleum oil. As a lubrication oil additive, a detergent dispersant, antioxidant, viscosity index improver/pour point depressant, oiliness agent/extreme pressure additive, antiwear agent, antirust/anticorrosive agent, etc. may be mentioned, while as a grease additive, a structural stabilizer, filler, or other fuel oil additive etc. may be mentioned. The water referred to here may be pure water, distilled water, tap water, industrial water, etc. It is not particularly limited so long as water meeting the conditions of the substances to be mixed. Further, the temperature of the water is not particularly limited. Hot water or cold water may be used.

Further, it is also possible to run a first resin through the line 131 through which one substance flows and a second resin, solvent, curing agent, and coloring agent through the line 136 through which the other substance flows and mix these by the fluid mixer 136. The "resin" referred to here is a molten resin, liquid resin, or other main ingredient of an adhesive or coat forming ingredient of a coating. The molten resin is not particularly limited so long as a resin which can be injection molded or extruded. Polyethylene, polypropylene, polyvinyl chloride, polystyrene, tetrafluoroethylene-perfluoroalkyl vinyl ether copolymer, ABS resin, acryl resin, polyamide, nylon, polyacetal, polycarbonate, modified polyphenylene ether, polybutylene terephthalate, polyethylene terephthalate, polyphenylene sulfide, polyether ether ketone, etc. may be mentioned.

As the liquid resin or other main ingredient of an adhesive, an acrylic resin-based adhesive, α-olefin-based adhesive, urethane resin-based adhesive, ether-based cellulose, ethylene-vinyl acetate resin adhesive, epoxy resin-based adhesive, vinyl chloride resin solvent-based adhesive, chloroprene rubber-based adhesive, vinyl acetate resin-based adhesive, cyanoacrylate-based adhesive, silicone-based adhesive, water-based polymer-isocyanate-based adhesive, styrene-butadiene rubber solution-based adhesive, styrene-butadiene rubber-based latex adhesive, nitrile rubber-based adhesive, nitrocellulose adhesive, reactive hot melt adhesive, phenol resin-based adhesive, modified silicone-based adhesive, polyamide resin hot melt adhesive, polyimide-based adhesive, polyurethane resin hot melt adhesive, polyolefin resin hot melt adhesive, polyvinyl acetate resin solution-based adhesive, polystyrene resin solvent-based adhesive, polyvinyl alcohol-based adhesive, polyvinyl pyrrolidone resin-based adhesive, polyvinyl butyral resin-based adhesive, polybenzimidazole adhesive, polymethacrylate resin solution-based adhesive, melamine resin-based adhesive, urea resin-based adhesive, resorcinol-based adhesive, etc. may be mentioned. As the coating forming ingredient of the coating, an acryl resin, urethane resin, melamine resin, etc. may be mentioned.

As the solvent, hexane, benzene, toluene, diethyl ether, chloroform, ethyl acetate, tetrahydrofuran, methylene chloride, acetone, acetonitrile, dimethylsulfoxide, dimethylformamide, dimethylacetoamide, N-methylpyrrolidone, ethanol, methanol, etc. may be mentioned. As the curing agent, polyamine, acid anhydrides, amines, peroxides, saccharin, etc. may be mentioned. As the coloring agents, zinc white, lead white, lithopone, titanium dioxide, precipitated barium sulfate, barite powder, red lead, iron oxide red, yellow lead, zinc yellow, ultramarine blue, potassium ferrocyanide, carbon black, and other pigments may be mentioned.

Here, when the above resin is a molten resin, it is also possible to form an apparatus running molten resin from a molding machine or extruder to the fluid mixer 136. For example, in the case of a molding machine, it is possible to arrange the fluid mixer 136 between the nozzle of the molding machine and mold for injection molding or, in the case of an extruder, arrange the fluid mixer 136 between the extruder and die for extrusion. In this case, it is possible to make the temperature in the resin uniform, stabilize the viscosity of the resin, suppress unevenness of thickness or generation of internal stress, and eliminate unevenness of color.

Further, it is also possible to run a first food material through the line 131 through which one substance flows and a second food material, food additive, seasoning, or nonflammable gas through the line 132 through which the other substance flows and mix these by the fluid mixer 136.

The first and second food materials need only be beverages or foods which can flow through pipelines. Sake rice wine, shochu distilled spirits, beer, whisky, wine, vodka, and other alcoholic beverages, milk, yoghurt, butter, cream, cheese, condensed milk, milk fat, and other milk products, juice, tea, coffee, soymilk, water, and other beverages, soup stock, miso soup, consommé soup, corn soup, tonkotsu pig bone soup, and other liquid foods, and also jelly, konjak powder paste, pudding, chocolate, ice cream, candies, tofu, paste products, beaten egg, gelatin, and other various food materials etc. may be mentioned. Further, if fluid in nature, a solid or powder is also possible. Flour, potato starch, strong wheat flour, weak wheat flour, buckwheat flour, powdered milk, coffee, cocoa, and other powder materials or meat, fruit pulp, wakame seaweed, sesame seeds, green layer, kezuribushi dried fish shavings, bread crumbs, minced or grated food or other small solid foods etc. may be mentioned.

As the food additive, brown sugar, evaporated cane juice, fructose, maltose, honey, molasses, maple syrup, starch syrup, erythritol, trehalose, maltitol, palatinose, xylitol, sorbitol, somatin, saccharin sodium, cyclamic acid, dulcin, aspartame, acesulfame potassium, sucralose, neotame, or other sweeteners, caramel color, gardenia coloring, anthocyanin coloring, annatto coloring, paprika coloring, safflower coloring, monascus coloring, flavonoid coloring, cochineal coloring, Amaranth, Erythrosine, Allura Red AC, New Coccine, Phloxine, Rose Bengal, Acid Red, Tartrazine, Sunset Yellow FCF, Fast Green FCF, Brilliant Blue FCF, Indigo Carmine, and other coloring agents, sodium benzoate, ε-polylysine, soft roe protein extract (protamine), potassium sorbate, sodium, sodium dehydroacetate, Thujaplicin (hinokitol), or other preservatives, ascorbic acid, tocopherol, dibutyl hydroxytoluene, butyl hydroxyanisole, sodium erythorbate, sodium sulfite, sulfur dioxide, chlorogenic acid, catechinic acid, or other antioxidants, flavors and fragrances, etc. may be mentioned.

As the seasoning, soysauce, sauce, vinegar, oil, chile sauce, miso soybean paste, ketchup, mayonnaise, salad dressing, sweet sake, and other liquid seasonings or sugar, salt, pepper, Japanese pepper, powdered red pepper, and other powder seasonings etc. may be mentioned. Microorganisms promote the fermentation and breakdown of food and include mushrooms, mold, yeast, or other fungi and bacteria and other microorganisms. As the fungi, various types of mushrooms, *aspergillus*, etc. may be mentioned. As the bacteria, for example, *lactobacillus bifidus, lactobacillus, bacillus subtilis natto*, etc. may be mentioned. As the nonflammable gas, carbon dioxide gas etc. may be mentioned. For example, the mixer can be used for mixing sweet wort and carbon dioxide gas to produce beer.

Further, it is also possible to run air through the line 131 through which one substance flows and a flammable gas through the line 132 through which the other substance flows and mix these by the fluid mixer 136. As the flammable gas, methane, ethane, propane, butane, pentane, acetylene, hydrogen, carbon monoxide, ammonia, dimethyl ether, etc. may be mentioned.

Further, it is also possible run a first nonflammable gas through the line 131 through which one substance flows and a second nonflammable gas or steam through the line 132 through which the other substance flows and mix these by the fluid mixer 136. As the nonflammable gas, nitrogen, oxygen, carbon dioxide, argon gas, helium gas, hydrogen sulfide gas, sulfurous acid gas, sulfur oxide gas, etc. may be mentioned. Further, as another combination of the above, it is also possible to run water, a liquid chemical, or a food material through the line 131 through which one substance flows and air, a nonflammable gas, or steam through the line 132 through which the other substance flows and mix these by the fluid mixer 136.

Further, it is also possible to run a first synthesis intermediate through the line 131 through which one substance flows and the second synthesis intermediate, additives, liquid chemicals, or metal through the line 132 through which the other substance flows and mix these by the fluid mixer 136. The first and second synthesis intermediates mean compounds at the stage in the middle of synthesis appearing in the middle of the multistage synthesis process until the target compound. Compounds in the middle of synthesis obtained by mixing a plurality of chemicals, resins in the middle of refinement, pharmaceutical intermediates, etc. may be mentioned.

Note that the above different types of fluids may also be mixed using the above apparatus of FIG. 17. Further, in the apparatuses using fluid mixers of FIG. 16 and FIG. 17, it is also possible to provide a heater or vaporizer at each of the lines through which substances flow before merging and possible to provide heat exchangers at the downstream side of the fluid mixers. Further, it is also possible to set a measuring device at a line through which one substance flows before merging and provide a control unit for adjusting the output of the pump of the line through which the other substance flows in accordance with a parameter measured by that measuring device or to set a control valve at the line through which the other substance flows and provide another control valve for adjusting the opening degree of that control valve in accordance with a parameter of that measuring device (not shown). At this time, the measuring device may be any which can measure a parameter of the fluid required such as a flowmeter, current meter, densitometer, or pH meter. Further, it is also possible to install a static mixer in the flow path at the downstream side of the merging part of the lines. The fluid mixer may be used to make flow uniform in the axial direction of the flow path, while the static mixer may be used to make the flow uniform in the radial direction of the flow path, so the fluid can be mixed more uniformly.

The parts of the fluid mixer which form the main body 11, 41, 81 and housing may be any of polyvinyl chloride, polypropylene, polyethylene, etc. if made of a resin. In particular, when using a corrosive fluid as the fluid, polytetrafluoroethylene, polyvinylidene fluoride, tetrafluoroethylene-perfluoroalkyl vinyl ether copolymer resin, or another fluororesin is preferable. If made of a fluororesin, use for a corrosive fluid is possible. Further, even if corrosive gas passes through the parts, there is no longer any concern over corrosion of the pipe members, so this is preferred. Further, the members or part of the members which form the main body or housing may be transparent or semitransparent members. This is preferable in that in this case, it enables the state of mixing of the fluid to be visually confirmed. Further, depending on the substance running through the fluid mixer, the parts may be made of iron, copper, copper alloy, brass, aluminum, stainless steel, titanium, or other metal or alloy.

In the above embodiments, although the branch flow paths 7*a* to 7*j* and the communicating holes 18, 32, 48, and 97 are used to communicate the first and second spiral flow paths and the second flow path at a plurality of locations in the flow direction, the configuration of the branch flow paths is not limited to the ones explained above. For example, it is also possible to make the plurality of branch flow paths different shapes at different parts (for example, shapes of different cross-sectional areas) or to change the pitches at which the communicating flow paths are arranged in the longitudinal direction. The main flow path and the branch flow paths also need not be straight. Further, although the spiral flow paths 5 and 6 are made substantially ring-shaped, other shapes (for example, rectangular shapes) are also possible if provided so as to cover the surroundings of the main flow path. In FIG. 5, FIG. 8, etc., at the outer circumferences of the main bodies 11 and 41, the first and second spiral grooves 16, 17, 46, and 47 are formed. However, so long as forming the first and second spiral flow paths 20, 21, 46, and 47 at the mating faces of the main bodies 11 and 41 and housing (cylindrical members 19, cylindrical member 51), other members (for example, the inner circumference of the housing) may also be provided with spiral grooves. It is also possible to interpose a ring-shaped member formed with a spiral shaped hole between the main body and the housing. In FIG. 8, one end of the main body 41 is connected to the connector 52, while the other end is connected to the connector 54. However, the configuration of the first flow path forming part which forms the first flow path 44 and the configuration of the second flow path forming part which forms the second flow path 45 together with the space 57 are not limited to this. For example, as shown in FIG. 13, reducers 75 and 76 may also be connected. As shown in FIG. 15, one end and the other end of the cylindrical members 111 and 112 are provided with the pipeline 115 and pipeline 128. The pipeline 115 and the pipeline 128 may also be used to respectively form the first flow path 123 and the second flow path 124. In FIG. 16, the lines 131 and 132 and merging part 133, while in FIG. 17, the lines 137, 138, and 141 and merging parts 139 and 142 are used to form flow paths for merging and guiding a plurality of different types of fluids, but the flow path forming means is not limited to these.

Note that, the above first embodiment to sixth embodiment can be freely combined to form a fluid mixer. That is, so long as the features and functions of the present invention can be realized, the present invention is not limited to the fluid mixers of the embodiments.

According to the present invention, the following advantageous effects are obtained.

(1) Even in a state where the concentration of a chemical temporarily becomes denser or thinner in a flow path, it is possible to mix the fluid while making the distribution of concentration of the fluid in the direction of flow uniform without any unevenness. Therefore, it is possible to supply the fluid in a stable concentration.

(2) Even in a state in which the temperature of the fluid temporarily becomes higher or becomes lower in a flow path, it is possible to mix the fluid while making the distribution of temperature of the fluid in the direction of flow uniform with no unevenness. Therefore, it is possible to supply fluid by a stable temperature.

(3) The fluid mixer can be made smaller in size and the installation space of the fluid mixer can be kept to the minimum necessary.

REFERENCE SIGNS LIST

1 fluid inlet
2 first flow path
3 fluid outlet
4 second flow path
5 first spiral flow path
6 second spiral flow path
7*a* to 7*j* branch flow paths
8 densitometer
9 densitometer
11, 41 main body
12, 42 fluid inlet
13, 44 first flow path
14, 43 fluid outlet
15, 45 second flow path
16, 46 first spiral groove
17, 47 second spiral groove
18, 48 communicating hole
19 cylindrical member
20, 49 first spiral flow path
21, 50 second spiral flow path
51 cylindrical member
52, 54 connector
53, 55 fastening nut
56 opening
57 space

The invention claimed is:

1. A fluid mixer, comprising:

a main flow path comprised of a first flow path and a second flow path;

a plurality of spiral flow paths formed around the second flow path in shapes substantially concentric with the second flow path, and provided offset in position from each other in a circumferential direction, the plurality of spiral flow paths having first ends communicated with the first flow path;

a plurality of branch flow paths branched from a plurality of locations of the second flow path in a flow direction, the plurality of branch flow paths being communicated with the plurality of spiral flow paths at a plurality of locations of the plurality of spiral flow paths in the flow direction;

a fluid inlet provided at an open end of either of the first flow path and the second flow path; and a fluid outlet provided at an open end of the other of the first flow path and the second flow path the fluid mixer, further comprising:

a main body having a plurality of spiral grooves formed at an outer circumferential surface thereof so that depths of the grooves become gradually shallower from one end in a longitudinal direction to the other end side, a conical space formed so that cross-sectional area of the conical space is reduced from the other end in the longitudinal direction to one end side, and a plurality of communicating holes opened so that the plurality of spiral grooves communicate with the conical space are formed; and a housing fit over the outer circumferential surface of the main body, the housing forming the plurality of spiral flow paths together with the plurality of spiral grooves, wherein one end of the housing is provided with a first flow path forming part communicating with ends of the plurality of spiral flow paths to form the first flow path, while the other end is provided with a second flow path forming part for forming the second flow path together with the conical space, wherein the plurality of communicating holes form the plurality of branch flow paths, wherein the first flow path and the second flow path are arranged separated from each other on the same axis, and wherein the fluid inlet is provided at an end of either of the first flow path forming part and the second flow path forming part, while the fluid outlet is provided at an end of the other of the first flow path forming part and the second flow path forming part.

2. The fluid mixer of claim 1, wherein the main body has a plurality of split members, the plurality of split members being coupled across a flow direction of the second flow path.

3. The fluid mixer of claim 2, wherein the split members are coupled so that the spiral flow paths have directions of spirals which are alternately reversed.

4. The fluid mixer of claim 1, wherein the housing has a cylindrical member and coupling members connected to both ends of the cylindrical member.

5. The fluid mixer of claim 1, wherein the housing has a plurality of housing members provided with flanges, the plurality of housing members being coupled with each other through the flanges in the longitudinal direction.

6. The fluid mixer of claim 5, wherein the housing members are a pair of cylindrical members, wherein the flanges are provided sticking out at one ends of the pair of cylindrical members to an outside in a radial direction, and wherein the main body is housed inside of the pair of cylindrical members and is fastened by connection of the flanges of the pair of cylindrical members.

7. The fluid mixer of claim 1, wherein an end of the housing is provided with a ferrule coupling part.

8. An apparatus using a fluid mixer, comprising:

the fluid mixer of claim 1; and a flow path forming portion for forming a flow path so as to merge and guide a plurality of different types of fluids to the fluid mixer.

* * * * *